US010017984B2

(12) United States Patent
Marzilli et al.

(10) Patent No.: US 10,017,984 B2
(45) Date of Patent: Jul. 10, 2018

(54) APPARATUS FOR SUPPORTING BLIND ROLLERS

(71) Applicant: Tribute Window Coverings Inc., Mississauga (CA)

(72) Inventors: Tony Marzilli, Mississauga (CA); Saffet Bayar, Pendik-Istanbul (TR)

(73) Assignee: Tribute Window Coverings Inc., Mississauga (CA)

( * ) Notice: Subject to any disclaimer, the term of this patent is extended or adjusted under 35 U.S.C. 154(b) by 49 days.

(21) Appl. No.: 15/182,982

(22) Filed: Jun. 15, 2016

(65) Prior Publication Data

US 2017/0362892 A1 Dec. 21, 2017

(51) Int. Cl.
*E06B 9/42* (2006.01)
*E06B 9/44* (2006.01)
(Continued)

(52) U.S. Cl.
CPC ..... *E06B 9/42* (2013.01); *E06B 9/44* (2013.01); *E06B 9/50* (2013.01); *E06B 9/56* (2013.01);
(Continued)

(58) Field of Classification Search
CPC ..... E06B 9/42; E06B 2009/2423; E06B 2009/2447; E06B 2009/2452; E06B 2009/405
(Continued)

(56) References Cited

U.S. PATENT DOCUMENTS 1,509,644 A * 9/1924 Forse, Jr. ..... E06B 9/50 160/122
3,372,728 A * 3/1968 Schaefer ..... A47H 2/02 160/39
(Continued)

FOREIGN PATENT DOCUMENTS

CA 2777454 11/2012
TR 201104892 11/2012

OTHER PUBLICATIONS

Ace Power Blinds Co., Ltd., "Components of Roller Shade Blinds", pp. 2/2 and 2/4, 2010 catalog.
(Continued)

*Primary Examiner* — Katherine W Mitchell
*Assistant Examiner* — Johnnie A. Shablack
(74) *Attorney, Agent, or Firm* — Bereskin & Parr LLP/S.E.N.C.R.L., s.r.l.

(57) ABSTRACT

An apparatus supports two blind rollers from a headrail in one of at least eight configurations. Each blind roller has a first end coupled to a first blind control mechanism and a second end coupled to a second blind control mechanism. The apparatus includes a bracket having a top flange for coupling the bracket to an end of the headrail. An inner face of the bracket has an upper engagement projection configured to secure at least one of: the first blind control mechanism for the upper blind roller in one of two mechanism orientations, and the second blind control mechanism for the upper blind roller. The inner face also has at least two lower engagement recesses, each configured to receive a lower engagement connector, the projection configured to secure at least one of the first blind control mechanism and the second blind control mechanism for the lower blind roller.

15 Claims, 19 Drawing Sheets

(51) Int. Cl.

| | |
|---|---|
| ***E06B 9/56*** | (2006.01) |
| ***E06B 9/72*** | (2006.01) |
| ***E06B 9/78*** | (2006.01) |
| ***E06B 9/50*** | (2006.01) |
| *E06B 9/24* | (2006.01) |
| *E06B 9/40* | (2006.01) |

(52) U.S. Cl.
CPC ..... *E06B 9/72* (2013.01); *E06B 9/78* (2013.01); *E06B 2009/2405* (2013.01); *E06B 2009/2452* (2013.01); *E06B 2009/2458* (2013.01); *E06B 2009/405* (2013.01); *E06B 2009/785* (2013.01)

(58) Field of Classification Search
USPC ..... 160/323.1–326, 241
See application file for complete search history.

(56) References Cited

U.S. PATENT DOCUMENTS 5,092,389 A * 3/1992 Tedeschi ..... E06B 9/50 160/321
6,148,894 A * 11/2000 Judkins ..... E06B 9/322 160/177 R
6,196,508 B1 * 3/2001 Nijs ..... A47H 1/13 248/267
6,817,402 B1 * 11/2004 Fraczek ..... E06B 9/42 160/323.1
6,935,401 B2 * 8/2005 Fraczek ..... E06B 9/50 160/321
6,981,539 B2 * 1/2006 Fraczek ..... E06L 39/32 160/173 R
7,891,399 B2 * 2/2011 Rasmussen ..... E06B 9/42 160/120
8,025,088 B2 * 9/2011 Kim ..... A47H 23/06 160/120
8,157,231 B2 * 4/2012 Shiu ..... F16C 13/00 226/177
8,220,520 B2 * 7/2012 Lukos ..... E04F 10/0662 160/242
8,403,020 B2 * 3/2013 Rasmussen ..... E06B 9/42 160/120
8,505,865 B2 * 8/2013 Wills ..... E06B 9/42 160/323.1
8,807,192 B2 * 8/2014 Marocco ..... A47H 23/00 160/120
8,820,386 B2 * 9/2014 Mullet ..... E06B 9/40 160/133
8,857,495 B2 10/2014 Marocco
8,887,787 B2 * 11/2014 Jang ..... E06B 9/42 160/120
8,967,227 B2 * 3/2015 Chou ..... A47H 1/14 160/23.1
9,004,142 B2 4/2015 Marocco
9,060,636 B2 * 6/2015 Cannaverde ..... E06B 9/174
9,062,493 B2 6/2015 Marocco
D748,409 S 2/2016 Marocco
D748,410 S 2/2016 Marocco
9,249,620 B2 * 2/2016 Kim ..... E06B 9/264
9,670,719 B2 * 6/2017 Marocco ..... E06B 9/24
2007/0084570 A1 * 4/2007 Lin ..... E06B 9/42 160/321
2007/0120031 A1 * 5/2007 Rasmussen ..... E06B 9/50 248/266
2008/0257505 A1 * 10/2008 Braybrook ..... E06B 9/42 160/321
2009/0173454 A1 * 7/2009 Cheng ..... E06B 9/40 160/120
2009/0277593 A1 * 11/2009 Stewart ..... E06B 9/40 160/127
2011/0024064 A1 * 2/2011 Ng ..... E06B 9/42 160/317
2013/0068398 A1 * 3/2013 Wills ..... E06B 9/42 160/26
2013/0098563 A1 * 4/2013 Jang ..... E06B 9/42 160/120
2013/0319624 A1 * 12/2013 Cannaverde
2014/0166218 A1 * 6/2014 Ng ..... E06B 9/42 160/120
2014/0352898 A1 * 12/2014 Veatch ..... E06L 39/13 160/323.1
2015/0007949 A1 * 1/2015 Daniels ..... E06B 9/50 160/323.1
2015/0034260 A1 * 2/2015 Blair ..... E06B 9/42 160/310
2015/0345216 A1 * 12/2015 Feldstein ..... E06L 39/50 160/310
2015/0376941 A1 * 12/2015 Fujita ..... E06B 9/26 160/241
2016/0076302 A1 3/2016 Marocco
2016/0319593 A1 * 11/2016 Dwarka ..... E06B 9/40
2016/0348428 A1 * 12/2016 Cheng ..... E06B 9/40

OTHER PUBLICATIONS

Ace Power Blinds Co., Ltd., "Components of Pleated Shades", p. 8/8, 2010 catalog.

* cited by examiner

APPARATUS FOR SUPPORTING BLIND ROLLERS

FIELD

This disclosure relates generally to apparatus for supporting blind rollers, and more specifically to apparatus for supporting two blind rollers from a headrail in one of at least eight configurations, and to apparatus for supporting four blind rollers from a headrail in one of at least two configurations.

INTRODUCTION

Roller blinds are well known. Such blinds are commonly used, for example, to selectively control the passage of light through openings (e.g. windows, glass doors, and the like) in residential, commercial, and industrial buildings.

Typically, many of the components used in an assembly for supporting blind rollers are designed to be assembled in a particular configuration. Accordingly, if a different configuration for the assembled blind is desired, different components may be required. For example, in a dual roller blind assembly, a configuration in which the control cords for the blinds are to be provided on the left hand side of the blinds generally requires a different set of components than would be required for a configuration in which the control cords for the blinds are to be provided on the right hand side of the blinds. This generally limits the number of possible configurations for the blind assembly once a set of components has been ordered and/or provided at a site where the blind assembly is to be installed.

Also, it is common in dual roller blind assemblies for the control cords for the blinds to be installed on the same side of the blinds. Accordingly, if it is desired to have controls for one of the blinds on one side of the assembly and controls for the other blind on the other side, this may require additional and/or custom components.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with a broad aspect, there is provided an apparatus for supporting an upper blind roller and a lower blind roller from a headrail in one of at least eight configurations, the headrail having a front edge, each blind roller having a first end coupled to a first blind control mechanism, and a second end coupled to a second blind control mechanism, the apparatus comprising: a bracket having an inner face, an outer face, and a top flange for coupling the bracket to an end of the headrail, the inner face having an upper engagement projection configured to releasably secure at least one of: the first blind control mechanism for the upper blind roller in one of at least two mechanism orientations, and the second blind control mechanism for the upper blind roller, the inner face also having at least two lower engagement recesses, each lower engagement recess configured to releasably receive a lower engagement connector, the lower engagement connector configured to releasably secure at least one of: the first blind control mechanism for the lower blind roller, and the second blind control mechanism for the lower blind roller; wherein, in a first configuration: the first blind control mechanism for the upper blind roller is securable to the bracket by the upper engagement projection in a first mechanism orientation, the lower engagement connector is securable in a first of the at least two lower engagement recesses, and the first blind control mechanism for the lower blind roller is securable to the bracket by the lower engagement connector; wherein, in a second configuration: the first blind control mechanism for the upper blind roller is securable to the bracket by the upper engagement projection in the first mechanism orientation, the lower engagement connector is securable in the first lower engagement recess, and the second blind control mechanism for the lower blind roller is securable to the bracket by the lower engagement connector; wherein, in a third configuration: the second blind control mechanism for the upper blind roller is securable to the bracket by the upper engagement projection, the lower engagement connector is securable in the first lower engagement recess, and the first blind control mechanism for the lower blind roller is securable to the bracket by the lower engagement connector; wherein, in a fourth configuration: the second blind control mechanism for the upper blind roller is securable to the bracket by the upper engagement projection, the lower engagement connector is securable in the first lower engagement recess, and the second blind control mechanism for the lower blind roller is securable to the bracket by the lower engagement connector; wherein, in a fifth configuration: the first blind control mechanism for the upper blind roller is securable to the bracket by the upper engagement projection in a second mechanism orientation, the lower engagement connector is securable in a second of the at least two lower engagement recesses, and the first blind control mechanism for the lower blind roller is securable to the bracket by the lower engagement connector; wherein, in a sixth configuration: the first blind control mechanism for the upper blind roller is securable to the bracket by the upper engagement projection in the second mechanism orientation, the lower engagement connector is securable in the second lower engagement recess, and the second blind control mechanism for the lower blind roller is securable to the bracket by the lower engagement connector; wherein, in a seventh configuration: the second blind control mechanism for the upper blind roller is securable to the bracket by the upper engagement projection, the lower engagement connector is securable in the second lower engagement recess, and the first blind control mechanism for the lower blind roller is securable to the bracket by the lower engagement connector; and wherein, in an eighth configuration: the second blind control mechanism for the upper blind roller is securable to the bracket by the upper engagement projection, the lower engagement connector is securable in the second lower engagement recess, and the second blind control mechanism for the lower blind roller is securable to the bracket by the lower engagement connector.

In some embodiments, the first blind control mechanism for the upper blind roller comprises a control cord, and wherein, in the first mechanism orientation, the control cord is angled forwardly, and wherein, in the second mechanism orientation, the control cord is angled rearwardly.

In some embodiments, the inner face further comprises a front control cord separating projection positioned below and forward of the upper engagement projection, and a rear control cord separating projection positioned below and rearward of the upper engagement projection.

In some embodiments, the first lower engagement recess is positioned forward of the upper engagement projection, and the second lower engagement recess is positioned rearward of the upper engagement projection.

In some embodiments, the first blind control mechanism for the upper blind roller comprises a clutch mechanism, and the second blind control mechanism for the upper blind roller comprises an end plug.

In some embodiments, the first blind control mechanism for the lower blind roller comprises a clutch mechanism, and the second blind control mechanism for the lower blind roller comprises an end plug.

In some embodiments, the first blind control mechanisms for the upper and lower blind rollers are configured such that, in each of the first, second, third, fourth, fifth, sixth, seventh, and eighth configurations, the first blind control mechanisms are interchangeable with each other.

In some embodiments, the first blind control mechanism for the upper blind roller comprises an electric motor.

In some embodiments, the bracket is a first bracket, and the apparatus further comprises a second bracket having an inner face, an outer face, and a top flange for coupling the second bracket to another end of the headrail; the inner face of the second bracket having a second upper engagement projection configured to releasably secure at least one of: the first blind control mechanism for the upper blind roller in one of at least two mechanism orientations, and the second blind control mechanism for the upper blind roller; the inner face of the second bracket also having at least two second lower engagement recesses, each second lower engagement recess configured to releasably receive a second lower engagement connector, the second lower engagement connector configured to releasably secure at least one of: the first blind control mechanism for the lower blind roller, and the second blind control mechanism for the lower blind roller.

In some embodiments, the first and second brackets are configured such that, in each of the first, second, third, fourth, fifth, sixth, seventh, and eighth configurations, the first and second brackets are interchangeable with each other.

In another broad aspect, there is provided an apparatus for supporting first and second upper blind rollers and first and second lower blind rollers from a headrail, the headrail having a front edge, each blind roller having a first end coupled to a first blind control mechanism, and a second end coupled to a second blind control mechanism, the apparatus comprising: a pair of end brackets, each end bracket having an inner face, an outer face, and a top flange for coupling each end bracket to an opposing end of the headrail, the inner face of each end bracket having an upper engagement projection configured to releasably secure the first blind control mechanism of one of the upper blind rollers in one of at least two mechanism orientations; the inner face of each end bracket also having first and second lower engagement recesses, each lower engagement recess configured to releasably receive a lower engagement connector, each lower engagement connector configured to releasably secure the second blind control mechanism of one of the lower blind rollers; and an intermediate bracket having a pair of opposed outer faces, and a top flange for coupling the intermediate bracket to a portion of the headrail located between the opposing ends of the headrail in one of a forward orientation and a rearward orientation, the outer faces of the intermediate bracket each having an intermediate upper engagement projection for releasably securing the second blind control mechanism of one of the upper blind rollers, and an intermediate lower engagement projection for releasably securing the second blind control mechanism of one of the lower blind rollers, wherein in the forward orientation, the intermediate lower engagement projections are positioned forward of the intermediate upper engagement projections, and in the rearward orientation, the intermediate lower engagement projections are positioned rearward of the intermediate upper engagement projections; wherein, in a first configuration: the intermediate bracket is in the forward orientation, and lower engagement connectors are securable in one of the first and second lower engagement recesses of each end bracket, such that the lower engagement connectors and the intermediate lower engagement projections define a forward lower blind axis, the first blind control mechanisms for the upper blind rollers are each securable to one of the end brackets by the upper engagement projection of an adjacent end bracket in a rearward mechanism orientation, the second blind control mechanisms for the upper blind rollers are each securable to one of the intermediate upper engagement projections, the first blind control mechanisms for the lower blind rollers are each securable to one of the end brackets by the lower engagement connector secured in the adjacent end bracket, and the second blind control mechanisms for the lower blind rollers are each securable to one of the intermediate lower engagement projections; and wherein, in a second configuration: the intermediate bracket is in the rearward orientation, and the lower engagement connectors are securable in one of the first and second lower engagement recesses of each end bracket, such that the lower engagement connectors and the intermediate lower engagement projections define a rearward lower blind axis, the first blind control mechanisms for the upper blind rollers are each securable to one of the end brackets by the upper engagement projection of that end bracket in a forward mechanism orientation, the second blind control mechanisms for the upper blind rollers are each securable to one of the intermediate upper engagement projections, the first blind control mechanisms for the lower blind rollers are each securable to one of the end brackets by the lower engagement connector securable in the adjacent end bracket, and the second blind control mechanisms for the lower blind rollers are each securable to one of the intermediate lower engagement projections.

In some embodiments, for each end bracket: (i) the first lower engagement recess is offset to one side of the upper engagement projection, and (ii) the second lower engagement recess is offset to another side of the upper engagement projection.

In some embodiments, the first blind control mechanisms for the upper blind rollers each comprise a control cord.

In some embodiments, the inner face of each end bracket further comprises a first control cord separating projection positioned below and offset to one side of the upper engagement projection of that end bracket, and a second control cord separating projection positioned below and offset to another side of the upper engagement projection of that end bracket.

In some embodiments, at least one of the first blind control mechanisms comprises an electric motor.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
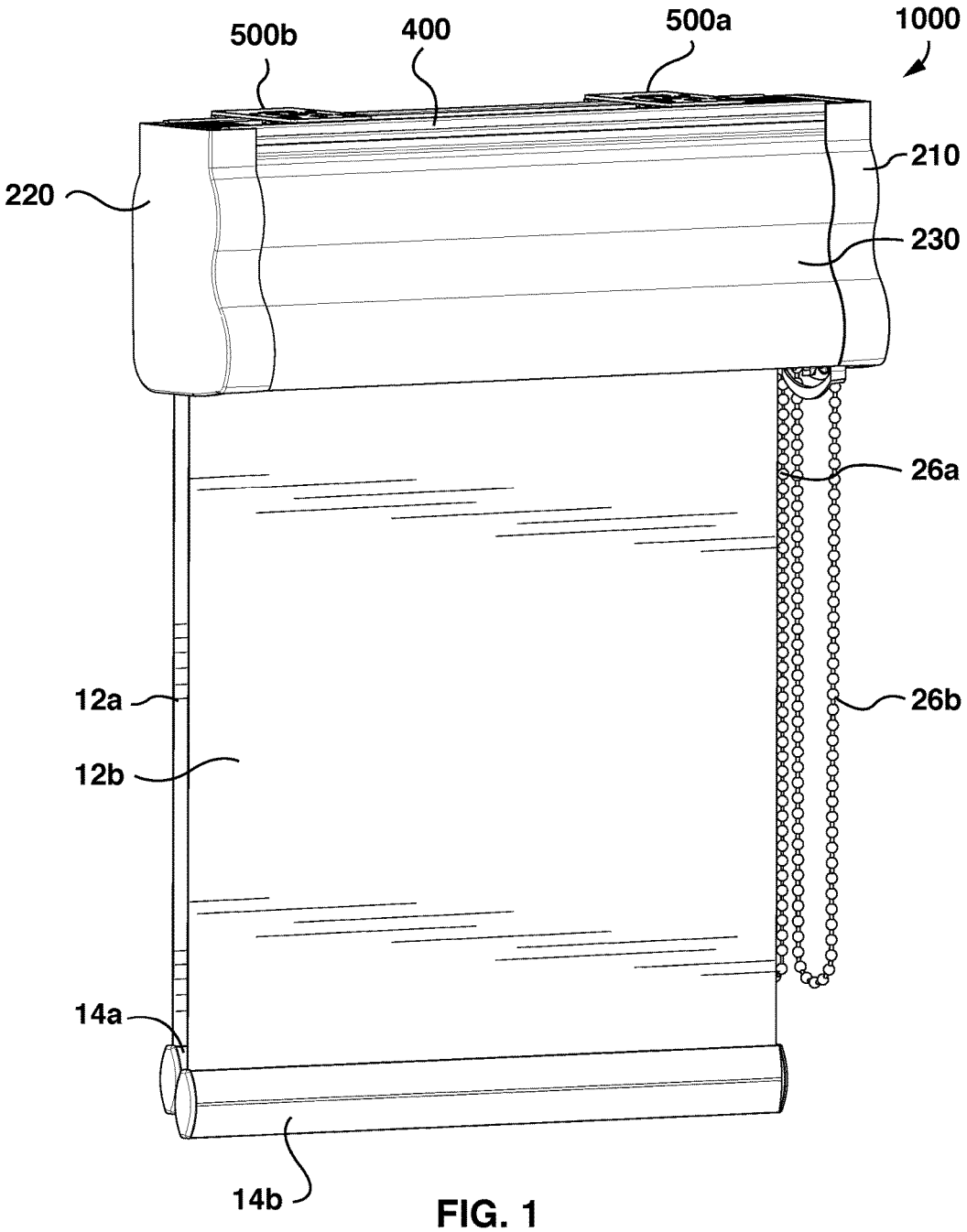
FIG. 1 is a perspective view of one configuration of a dual roller blind assembled using apparatus according to one embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

Figure 2:
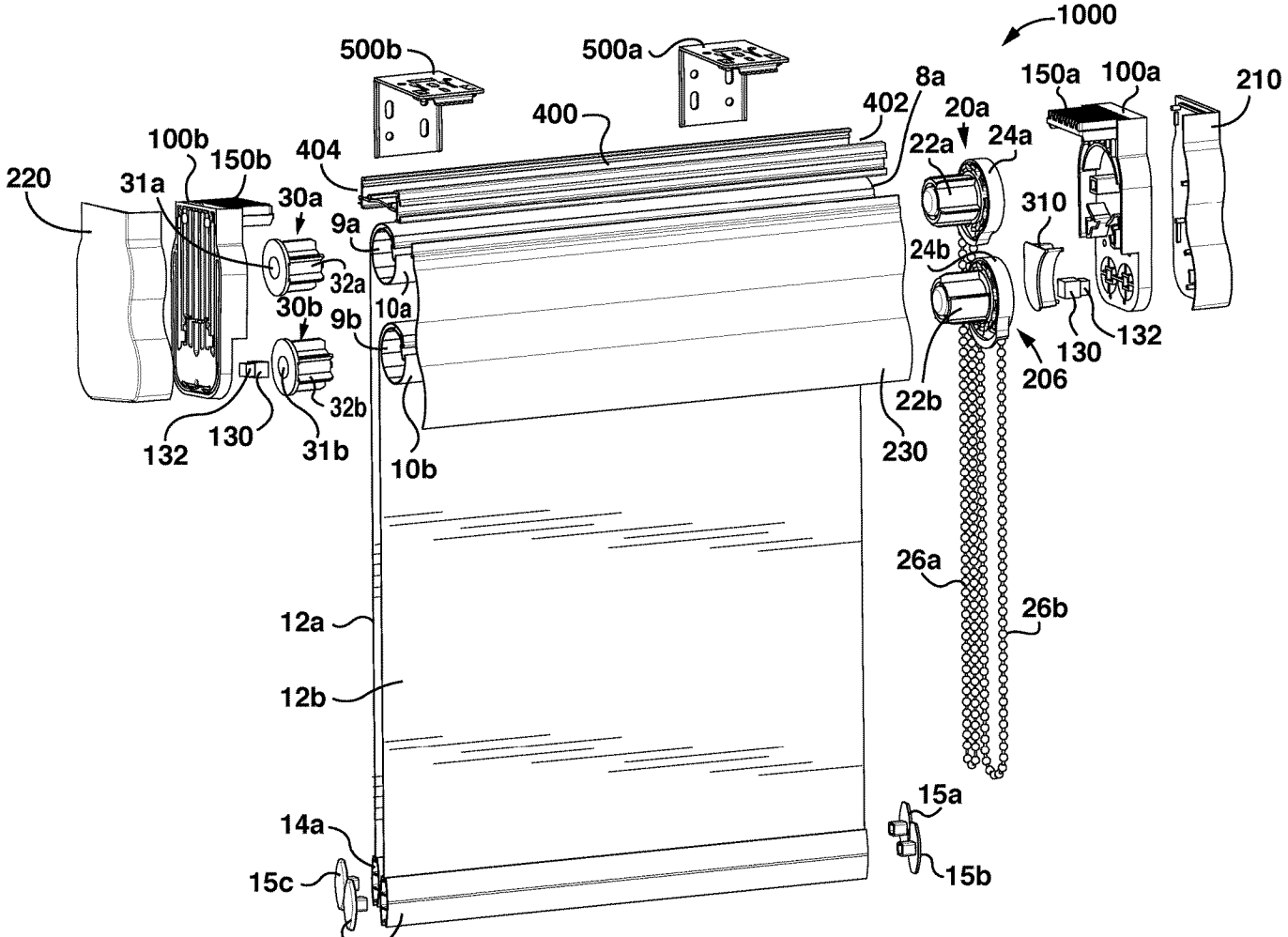
FIG. 2 is an exploded view of the assembly of FIG. 1.

FIGS. 1 and 2 illustrate a dual roller blind assembly 1000 for supporting two roller blinds that cover at least a portion of an opening or a transparent or translucent portion of a building (e.g. a window, glass door, glass wall, and the like). Assembly 1000 includes: a pair of end brackets 100*a*, 100*b* which, when assembled, support blind rollers 10*a*, 10*b* via first blind control mechanisms 20*a*, 20*b* and second blind control mechanisms 30*a*, 30*b*. The assembly 1000 also includes a headrail 400, which supports the end brackets (and thus the blind rollers); mounting brackets 500*a*, 500*b* for coupling the headrail to a wall and/or ceiling; and fascia plates 210, 220, and 230, which provide a pleasing aesthetic appearance to the blind assembly. Blinds 12*a*, 12*b* hang from blind rollers 10*a*, 10*b*, respectively.

As will be discussed further below, the brackets 100*a*, 100*b* and the blind control mechanisms 20*a*, 20*b*, 30*a*, and 30*b* can be assembled in a number of configurations. This allows an assembly 1000 to be configured using the same components to support two roller blinds in one of at least eight different configurations. As will be discussed further below, the flexibility of being able to provide eight configurations using the same components may have one or more advantages over typical dual roller blind assemblies. As shown in FIG. 2, each blind roller 10*a*, 10*b* is shown as an elongate tubular member with openings at each end. Blind rollers 10*a*, 10*b* may be any suitable length, and may be cut to a desired length during the installation process. In the illustrated embodiment, each blind roller is hollow, and has the same cross-sectional profile along its entire length. It will be appreciated that variant designs of blind rollers may be used in alternative embodiments. For example, a blind roller need not be hollow over its entire length.

In the illustrated embodiment, a first blind control mechanism 20*a* is inserted into the hollow portion at an end 8*a* of the upper blind roller 10*a*. When inserted into blind roller 10*a*, the outer surface 22*a* of the inserted portion of the mechanism 20*a* is configured to engage with the inner surface of the blind roller 10*a* to prevent rotation of the blind roller relative to the engaged surface 22*a* of the mechanism 20*a*. Similarly, a first blind control mechanism 20*b* is inserted into the hollow portion at an end (not shown) of the lower blind roller 10*b*. When inserted into blind roller 10*b*, the outer surface 22*b* of the inserted portion of the mechanism 20*b* is configured to engage with the inner surface of the blind roller 10*b* to prevent rotation of the blind roller relative to the engaged surface 22*b* of the mechanism 20*b*.

As will be discussed further below, when assembled, each first blind control mechanism allows a user to selectively rotate the blind roller to which the mechanism is coupled relative to the end brackets 100*a*, 100*b*, in order to raise or lower a blind supported by the blind roller. Preferably, the first blind control mechanisms 20*a*, 20*b* are interchangeable with each other. For example, as shown in FIG. 2, first blind control mechanism 20*a* is shown as being coupled to end 8*a* of the upper blind roller 10*a*, and first blind control mechanism 20*b* is shown as being coupled to end 8*b* of the lower blind roller 10*b*. Alternatively, first blind control mechanism 20*a* could be coupled to end 8*b* of lower blind roller 10*b* and first blind control mechanism 20*b* could be coupled to end 8*a* of the upper blind roller 10*a* to provide an equivalent assembled configuration. Accordingly, a first blind control mechanism may be referred to generically herein as a first blind control mechanism 20, having an outer surface 22 and a mounting recess 21 (see FIG. 12).

Returning to FIG. 2, a second blind control mechanism 30*a* is inserted into the hollow portion at an opposite end 9*a* of the upper blind roller 10*a*. When inserted into the blind roller, the outer surface 32*a* of the inserted portion of the mechanism 30*a* is configured to engage with the inner surface of the blind roller 10*a* to prevent rotation of the blind roller relative to the engaged surface 32*a* of the mechanism 30*a*. Similarly, a second blind control mechanism 30*b* is inserted into the hollow portion at an end 9*b* of the lower blind roller 10*b*. When inserted into the blind roller, the outer surface 32*b* of the inserted portion of the mechanism 30*b* is configured to engage with the inner surface of the blind roller 10*b* to prevent rotation of the blind roller relative to the engaged surface 32*b* of the mechanism 30*b*.

As will be discussed further below, when assembled, each second blind control mechanism allows a blind roller to which the mechanism is coupled to be rotated relative to the end brackets 100*a*, 100*b*, so that a blind supported by the blind roller may be raised or lowered. As with the first blind control mechanisms, the second blind mechanisms 30*a*, 30*b* are preferably interchangeable with each other. For example, as shown in FIG. 2, second blind control mechanism 30*a* is shown as being coupled to end 9*a* of the upper blind roller 10*a*, and second blind control mechanism 30*b* is shown as being coupled to end 9*b* of the lower blind roller 10*b*. Alternatively, second blind control mechanism 30*a* could be coupled to end 9*b* of lower blind roller 10*b* and second blind control mechanism 30*b* could be coupled to end 9*a* of the upper blind roller 10*a* to provide an equivalent assembled configuration. Accordingly, a second blind control mechanism may be referred to generically herein as a second blind control mechanism 30, having an outer surface 32 and a mounting recess 31.

First and second blind control mechanisms 20, 30 may be secured to the blind rollers 10*a*, 10*b* using any suitable coupling method. For example, the first and second blind control mechanisms 20, 30 may be dimensioned to provide a friction fit when inserted into an end of a blind roller. Alternatively, or additionally, the first and second blind control mechanisms 20, 30 may be otherwise configured to be mechanically coupled to a blind roller (e.g. using a set screw or other mechanical fastener, etc.).

As shown in FIG. 2, the blind rollers 10*a*, 10*b* and first and second blind control mechanisms 20*a*, 20*b*, 30*a*, and 30*b* are supported by end brackets 100*a*, 100*b*. Preferably, the end brackets 100*a*, 100*b* are interchangeable with each other. That is, bracket 100*a* could be used in place of bracket 100*b*, and vice versa, to provide an equivalent assembled configuration.

Figure 3:
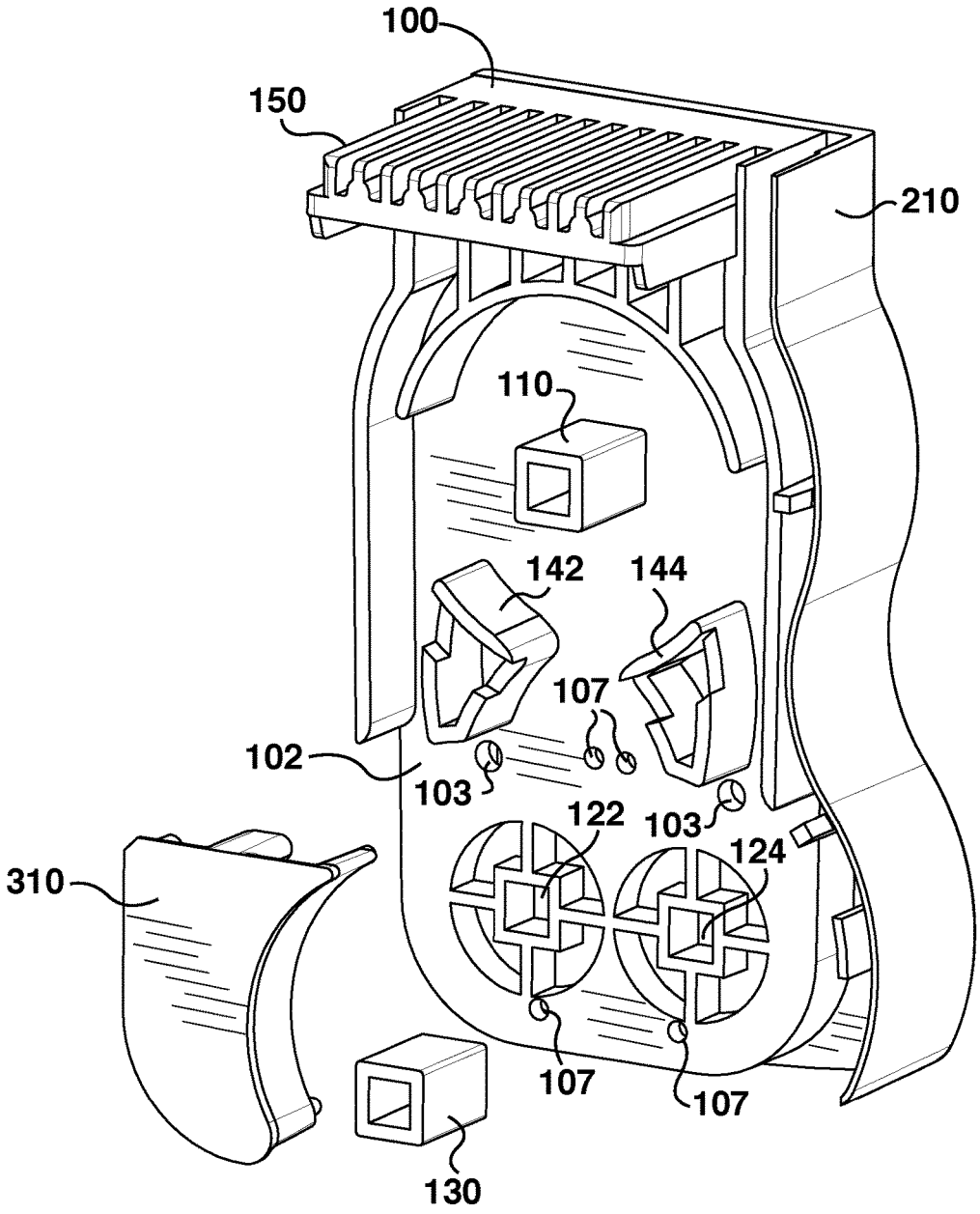
FIG. 3 is an interior perspective view of a bracket used in the assembly of FIG. 1, secured to an optional end plate, and a lower engagement connector and an optional control cord guide.

FIG. 3 illustrates an end bracket, referred to generically as end bracket 100. End brackets 100*a*, 100*b* shown in FIG. 2 are each examples of end bracket 100. As shown in FIG. 3, each end bracket 100 has an inner face 102. Inner face 102 has an upper engagement projection 110 extending therefrom. Upper engagement projection 110 is dimensioned to be received within a mounting recess 31 provided on a second blind control mechanism 30 (see e.g. bracket 100*b* in FIG. 2). Upper engagement projection 110 is also dimensioned to be received within a mounting recess 21 provided on a first blind control mechanism 20 (see e.g. bracket 100*a* in FIG. 2). Accordingly, either a first blind control mechanism 20 or a second blind control mechanism 30 may be secured to upper engagement projection 110.

When inserted into a mounting recess 31 of a second blind control mechanism, the outer surface of the upper engagement projection 110 is configured to engage with the inner surface of the mounting recess 31 to prevent rotation of the engaged surface of the recess 31 relative to the engagement projection 110. Accordingly, when a second blind control mechanism 30 is secured to upper engagement projection 110, the outer surface 32 of the inserted portion of the blind control mechanism 30 (and thereby the blind roller 10 to which the mechanism is coupled) may be rotated relative to the end bracket 100.

When inserted into a mounting recess 21 of a first blind control mechanism, the outer surface of the upper engagement projection 110 is configured to engage with the inner surface of mounting recess 21 to prevent rotation of the engaged surface of the recess 21 relative to the engagement projection 110. Accordingly, when a first blind control mechanism 20 is secured to upper engagement projection 110, a blind control cord 26 may be used to selectively rotate the outer surface 22 of the inserted portion of the blind control mechanism 20 (and thereby selectively rotate the blind roller 10 to which the mechanism is coupled) relative to the end bracket 100. In this way, blind control cord 26 may be used to raise and/or lower a blind.

Blind control cord 26 may be a rope, chain, ball chain, or any suitable mechanism that allows a user to selectively rotate blind roller 10 to raise and/or lower a blind. Alternatively, a first blind control mechanism 20 may not include a control cord, and may instead include an electric motor and suitable control circuitry (e.g. a power source, a receiver or transceiver, etc.) to allow a user to remotely raise and/or lower a blind.

Figure 17:
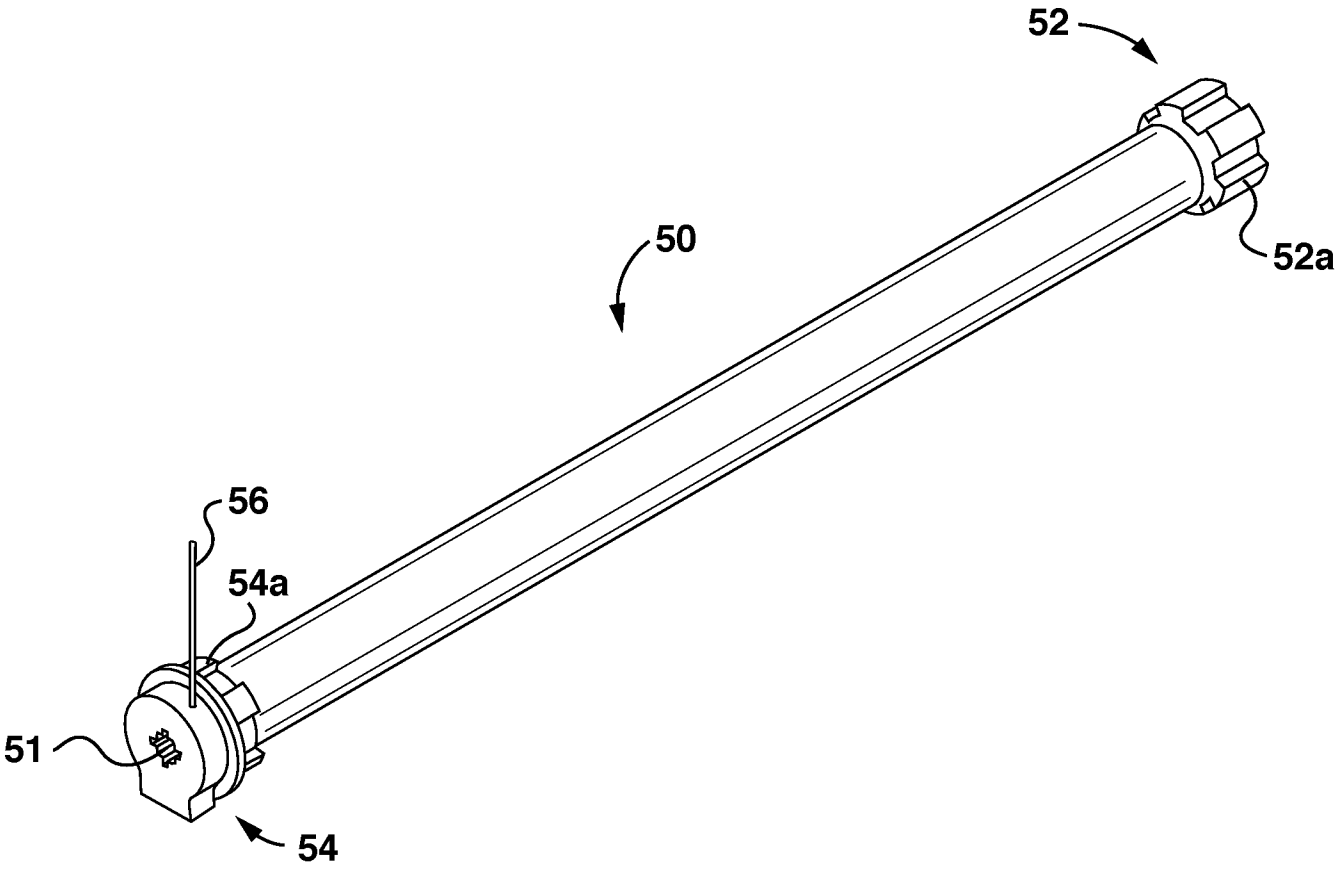
FIG. 17 is a perspective view of a motorized blind control mechanism.

FIG. 17 illustrates a motorized blind control mechanism 50 having a first end 52 and a second end 54. When first end 52 in inserted into the hollow portion at an end of a blind roller, and the first end 52 is advanced inside the hollow portion until an outer surface 54*a* at the second end 54 is positioned in the hollow portion of the blind roller, the outer surfaces 52*a* and 54*a* of the inserted mechanism 50 are configured to engage with the inner surface of the blind roller to prevent rotation of the blind roller relative to the engaged surfaces 52*a* and 54*a* of the mechanism 50.

Motorized blind control mechanism 50 also has a mounting recess 51 provided at the second end 54. Motorized blind control mechanism 50 may be secured to the upper engagement projection 110 and/or to the lower engagement connector 130 of a mounting bracket 100 using any suitable coupling method. For example, the recess 51 may be dimensioned to provide a friction fit when mounted on the engagement projection 110 and/or the engagement connector 130. Alternatively, an adapter (not shown) may be provided between recess 51 and engagement projection 110 and/or the engagement connector 130 engagement.

In operation, motorized blind control mechanism 50 receives a signal from a user (e.g. wirelessly via antenna 56) and, in response, uses an internal motor to rotate the outer surfaces 52*a* and 54*a* of the inserted mechanism 50 relative to the mounting recess 51, and thereby rotating the blind roller to which the mechanism is coupled relative to the end bracket 100. The motor may be driven by any suitable power source, including e.g. one or more on-board batteries or power drawn from an external power supply, such as an external battery or an AC cord that is configured to plug into a household electrical outlet. It will be appreciated that other configurations of a motorized blind control mechanism may be possible.

Returning to FIG. 3, inner face 102 of end bracket 100 also has two lower engagement recesses 124, 122. Each lower engagement recess 120 is dimensioned to receive a mounting projection 132 provided on a lower engagement connector 130 (see e.g. FIG. 2). When inserted into lower engagement recess 124 or 122, the outer surface of the mounting projection 132 is configured to engage with the inner surface of the mounting recess 120 to prevent rotation of the lower engagement connector 130 relative to the end bracket 100.

Lower engagement connector 130 is dimensioned to be received within mounting recess 31 provided on second blind control mechanism 30 (see e.g. bracket 100*b* in FIG. 2). Lower engagement connector 130 is also dimensioned to be received within a mounting recess 21 provided on first blind control mechanism 20 (see e.g. bracket 100*a* in FIG. 2). Accordingly, either a first blind control mechanism 20 or a second blind control mechanism 30 may be secured to lower engagement connector 130.

When inserted into a mounting recess 21 or 31 of a first or second blind control mechanism, respectively, the outer surface of lower engagement connector 130 is configured to engage with the inner surface of the mounting recess 21 or 31 to prevent rotation of the engaged surface of the recess 21 or 31 relative to the engagement connector 130.

First and second blind control mechanisms 20, 30 may be secured to the upper engagement projection 110 and to the lower engagement connector 130 using any suitable coupling method. For example, the recesses 21, 31 may be dimensioned to provide a friction fit when mounted on the engagement projection 110 and the engagement connector 130. As shown, upper engagement projections 110 and lower engagement connector 130 each have a square cross-sectional profile. It will be appreciated that other configurations may be possible. For example, the engagement projection and the engagement connector may have an alternative symmetrical profile (e.g. X-shaped, pentagonal, or hexagonal), or an asymmetric profile. Also, while the upper engagement projection and the lower engagement connector preferably have the same cross-sectional profile, it will be appreciated that the upper engagement projection 110 and the lower engagement connector 130 may have different profiles that still allow the engagement projections to be secured to either first blind control mechanism 20 or to second blind control mechanism 30. For example, upper engagement projection 110 may have a square profile, and lower engagement connector 130 may have an X-shaped profile.

As shown in FIG. 3, each end bracket 100 also has a top flange 150. Flange 150 may be used to couple the bracket 100 to an end of the headrail 400 using any suitable coupling method. For example, flange 150 may be dimensioned to provide a friction fit when inserted into the profile of headrail 400, e.g. as shown in FIG. 2. Alternatively, or additionally, flange 150 may be otherwise configured to be mechanically coupled to headrail 400 (e.g. using a set screw or other mechanical fastener, etc.). Headrail 400 may be any suitable length, and may be cut to a desired length during the installation process.

Since either a first blind control mechanism 20 or a second blind control mechanism 30 may be secured to upper engagement projection 110, and since either a first blind control mechanism 20 or a second blind control mechanism 30 may be secured to lower engagement connector 130 (which itself may be secured to an end bracket 100 in either of the lower engagement recesses 124, 122), an assembly 1000 may be configured to support two roller blinds in a number of different configurations using the same components.

Figure 5:
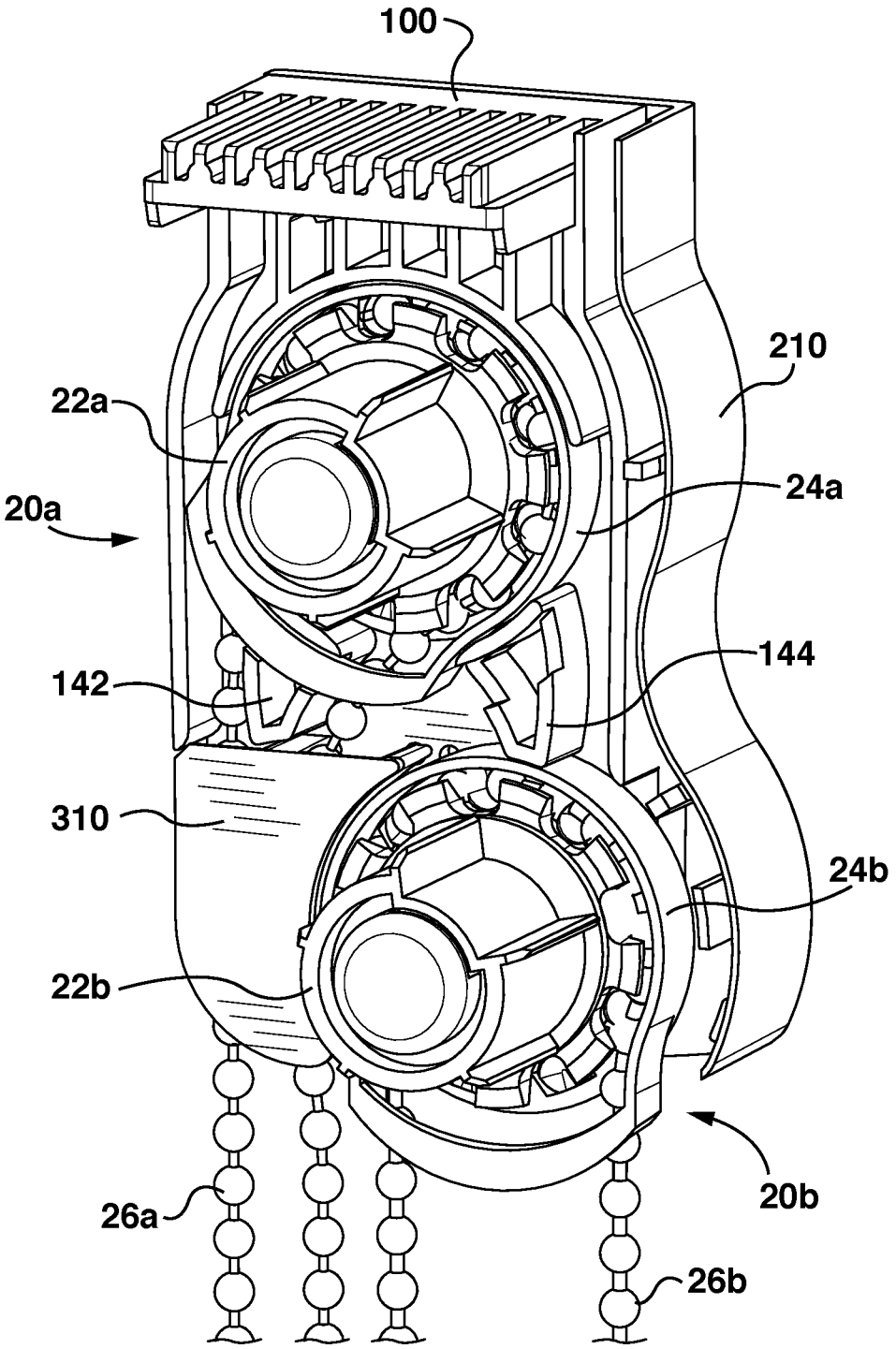
FIG. 5 is an interior perspective view of the bracket and end plate of FIG. 3 in a configuration in which a blind control mechanism for an upper blind roller is secured in a rearward mechanism orientation with the control cord guide secured to guide the control cord of the blind control mechanism for the upper blind roller, and a blind control mechanism for a lower blind roller is secured in a forward position using the lower engagement connector.

For example, as shown in FIG. 5, in one configuration a lower engagement connector 130 (not shown in FIG. 5) is inserted into lower engagement recess 124 (not shown in FIG. 5) of bracket 100, first blind control mechanism 20*a* for upper blind roller 10*a* (not shown in FIG. 5) is secured to bracket 100 via upper engagement projection 110 (not shown in FIG. 5), and first blind control mechanism 20*b* for lower blind roller 10*b* (not shown in FIG. 5) is secured to bracket 100 via lower engagement connector 130 (not shown in FIG. 5). Notably, first blind control mechanism 20*a* is secured to upper engagement projection 110 in an orientation in which the control cord 26*a* is directed away from the first blind control mechanism 20*b* for the lower blind roller 10*b*. More specifically, the control cord 26*a* is positioned around control cord separating projection 142.

Figure 4:
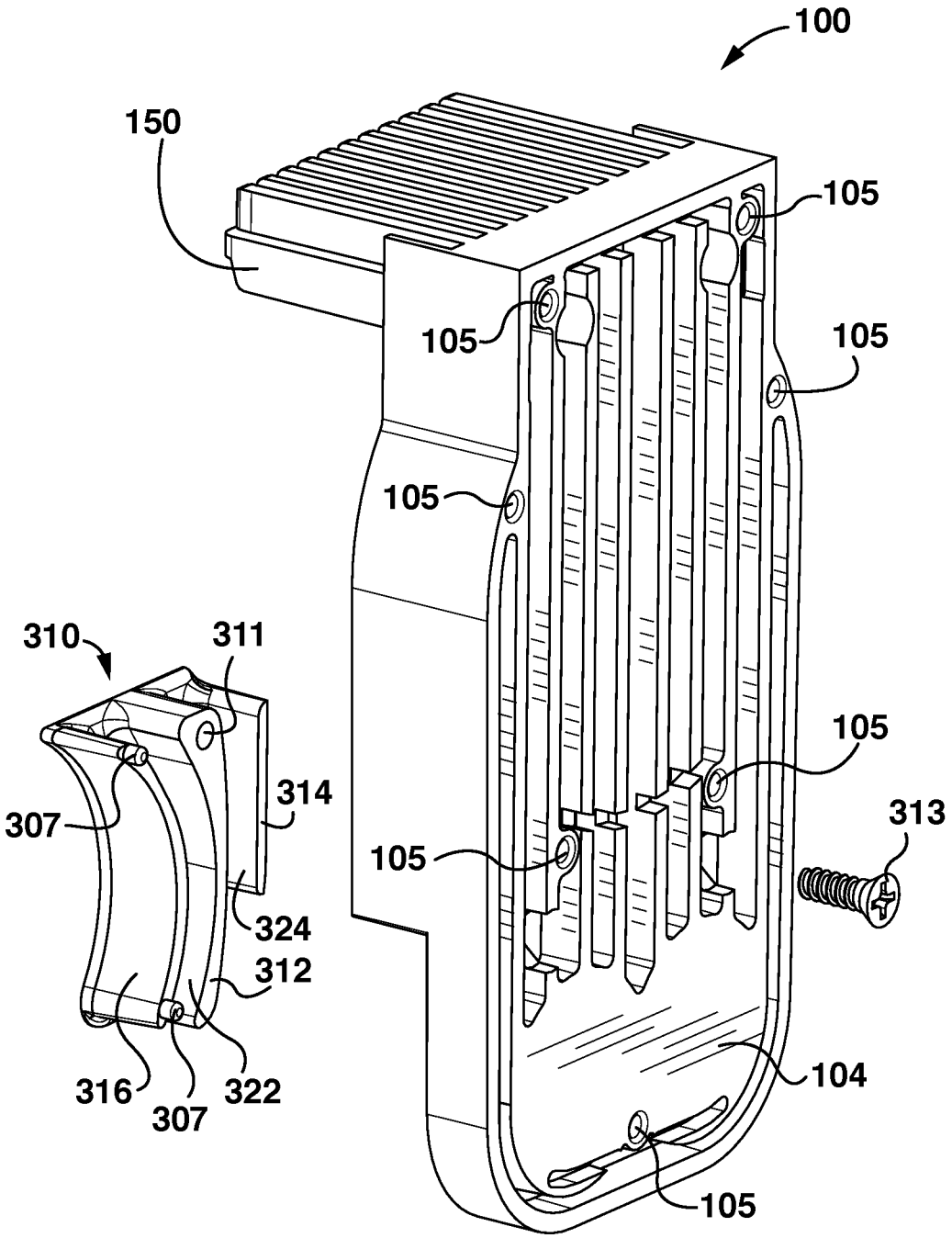
FIG. 4 is an exterior perspective view of the bracket and control cord guide of FIG. 3.

Also shown in FIGS. 4 and 5 is an optional control cord guard 310. When provided, control cord guard 310 is preferably secured to bracket 100 with the control cord 26 of a first blind control mechanism 20 (e.g. control cord 26*a* in FIG. 5) positioned in the channels 322, 324 defined by flanges 312, 314, and 316 (see FIG. 4). It will be appreciated that other configurations may be possible. As shown, control cord guard 310 is secured to bracket 100 by inserting projections 307 into bores 107, and a screw 313 is inserted through aperture 103 in bracket 100 and into bore 311. It will be appreciated that any suitable coupling method may alternatively be used.

Figure 6:
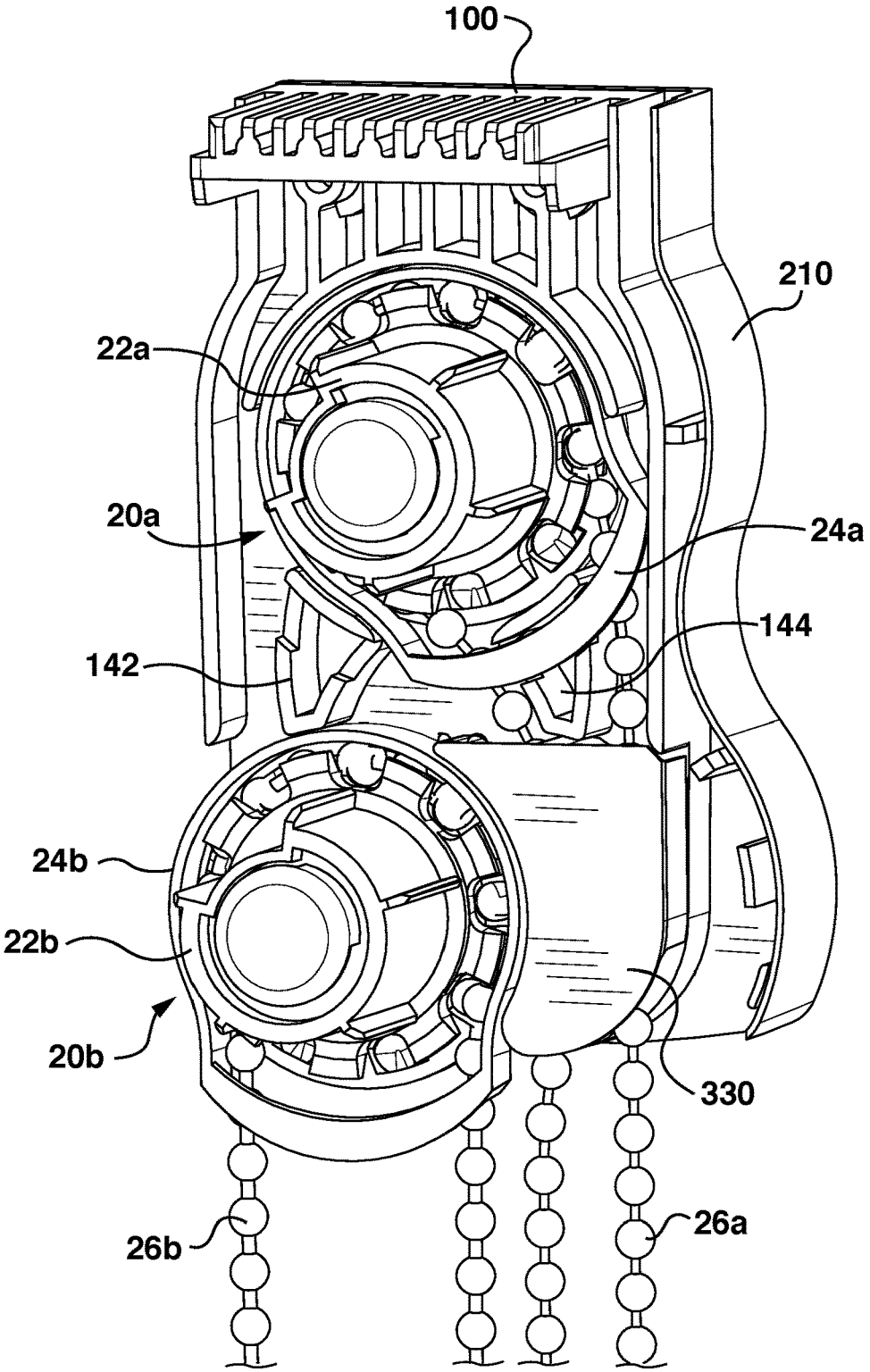
FIG. 6 is an interior perspective view of the bracket and end plate of FIG. 5 in another configuration in which the blind control mechanism for the upper blind roller is secured in a forward mechanism orientation with an optional control cord guide secured to guide the control cord of the blind control mechanism for the upper blind roller, and the blind control mechanism for the lower blind roller is secured in a rearward position using the lower engagement connector.

Another configuration is shown in FIG. 6. In this configuration, the lower engagement connector 130 (not shown in FIG. 6) is inserted into lower engagement recess 122 (not shown in FIG. 6) of bracket 100, a first blind control mechanism 20*a* for an upper blind roller 10*a* (not shown in FIG. 6) is secured to bracket 100 via upper engagement projection 110 (not shown in FIG. 6), and a first blind control mechanism 20*b* for a lower blind roller 10*b* (not shown in FIG. 6) is secured to bracket 100 via lower engagement connector 130. Notably, first blind control mechanism 20*a* is secured to upper engagement projection 110 in a different orientation than in the configuration shown in FIG. 5. In the orientation shown in FIG. 6, first blind control mechanism 20*a* is secured to upper engagement projection 110 so that the control cord 26*a* is directed away from the first blind control mechanism 20*b* for the lower blind roller 10*b*. More specifically, the control cord 26*a* is positioned around control cord separating projection 144.

Another optional control cord guide 330 is shown in FIG. 6. Control cord guide 330 is substantially a mirror-image of control cord guard 310, although this need not be the case.

Since each bracket 100, lower engagement connector 130, and any two of first or second blind control mechanisms 20, 30 can be assembled in a number of configurations, an assembly 1000 may be configured using the same components to support two roller blinds in one of at least eight different configurations.

For example, in the configuration shown in FIGS. 1 and 2, the lower blind roller 10*b* is secured in a forward position (i.e. away from a window being covered) relative to upper blind roller 10*a*, and the first blind control mechanisms 20*a*, 20*b* (and their control cords 26*a*, 26*b*) are on the right hand side of the blinds 12*a*, 12*b*.

In another configuration, as shown in FIG. 8, the lower blind roller 10*b* is secured in a rearward position, and the first blind control mechanisms 20*a*, 20*b* (and their control cords 26*a*, 26*b*) are on the right hand side of the blinds 12*a*, 12*b*.

Figure 10:
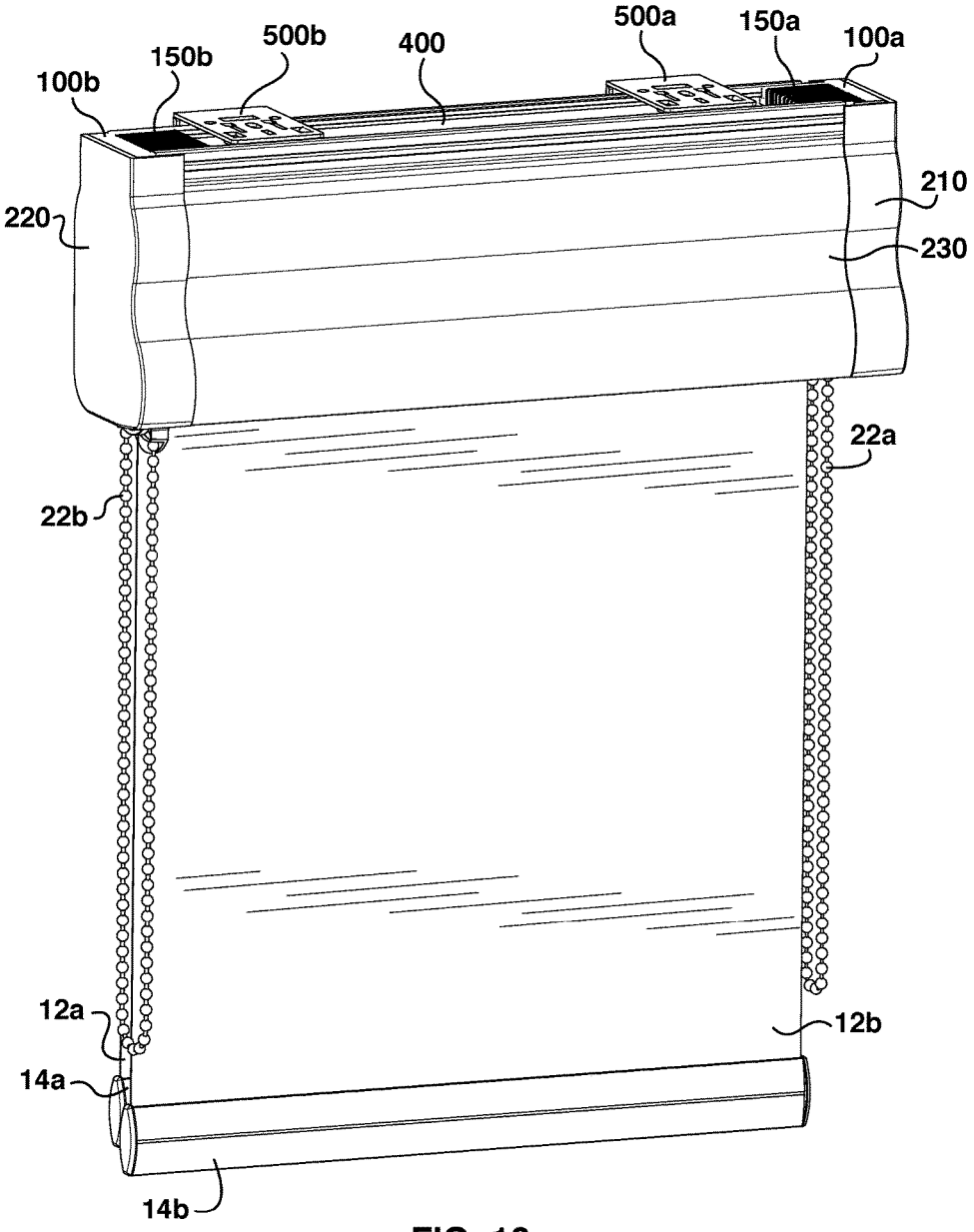
FIG. 10 is a perspective view of yet another configuration of a dual roller blind assembled using apparatus according to one embodiment.

In another configuration, as shown in FIG. 10, the lower blind roller 10*b* is secured in a forward position, the first blind control mechanism 20*a* (and control cord 26*a*) for the upper blind roller is on the right hand side of the blinds 12*a*, 12*b*, and the first blind control mechanism 20*b* (and control cord 26*b*) for the lower blind roller is on the left hand side of the blinds 12*a*, 12*b*.

In another configuration (not shown), the lower blind roller 10*b* is secured in a rearward position, the first blind control mechanism 20*a* (and control cord 26*a*) for the upper blind roller is on the right hand side of the blinds 12*a*, 12*b*, and the first blind control mechanism 20*b* (and control cord 26*b*) for the lower blind roller is on the left hand side of the blinds 12*a*, 12*b*.

In another configuration (not shown), the lower blind roller 10*b* is secured in a forward position, the first blind control mechanism 20*a* (and control cord 26*a*) for the upper blind roller is on the left hand side of the blinds 12*a*, 12*b*, and the first blind control mechanism 20*b* (and control cord 26*b*) for the lower blind roller is on the right hand side of the blinds 12*a*, 12*b*.

In another configuration (not shown), the lower blind roller 10*b* is secured in a rearward position, the first blind control mechanism 20*a* (and control cord 26*a*) for the upper blind roller is on the left hand side of the blinds 12*a*, 12*b*, and the first blind control mechanism 20*b* (and control cord 26*b*) for the lower blind roller is on the right hand side of the blinds 12*a*, 12*b*.

In another configuration (not shown), the lower blind roller 10*b* is secured in a forward position, and the first blind control mechanisms 20*a*, 20*b* (and their control cords 26*a*, 26*b*) are on the left hand side of the blinds 12*a*, 12*b*.

In another configuration (not shown), the lower blind roller 10*b* is secured in a rearward position, and the first blind control mechanisms 20*a*, 20*b* (and their control cords 26*a*, 26*b*) are on the left hand side of the blinds 12*a*, 12*b*.

As noted above, the flexibility of being able to provide eight configurations using the same components may have one or more advantages over typical blind assemblies. For example, this may reduce the number of components required to be manufactured and/or stocked. Also, this may simplify the installation procedure, as an installer will not be required to be familiar with as many different components. Also, this may provide additional options at the installation stage, as the same components that have been provided in anticipation of being installed in one configuration (e.g. with control cords on the right) may be installed in another configuration (e.g. with control cords on the left). This may allow a number of different configurations to be trialed on site to assist in selecting a preferred configuration.

Assembly 1000 may be provided with optional fascia end caps 210, 220. These fascia end caps may provide a pleasing aesthetic appearance to the blind assembly. Fascia end caps 210, 220 may be secured to the brackets 100*a*, 100*b* using any suitable coupling method. For example, end caps 210, 220 may be provided with one or more projections on their respective inner faces, the projections being dimensioned to provide a friction fit when inserted into complementary recesses on the outer face 104 of an end bracket 100 (e.g. bores 105 shown in FIG. 4). Alternatively, or additionally, the fascia end caps may be otherwise configured to be mechanically coupled to a bracket 100.

Figure 7:
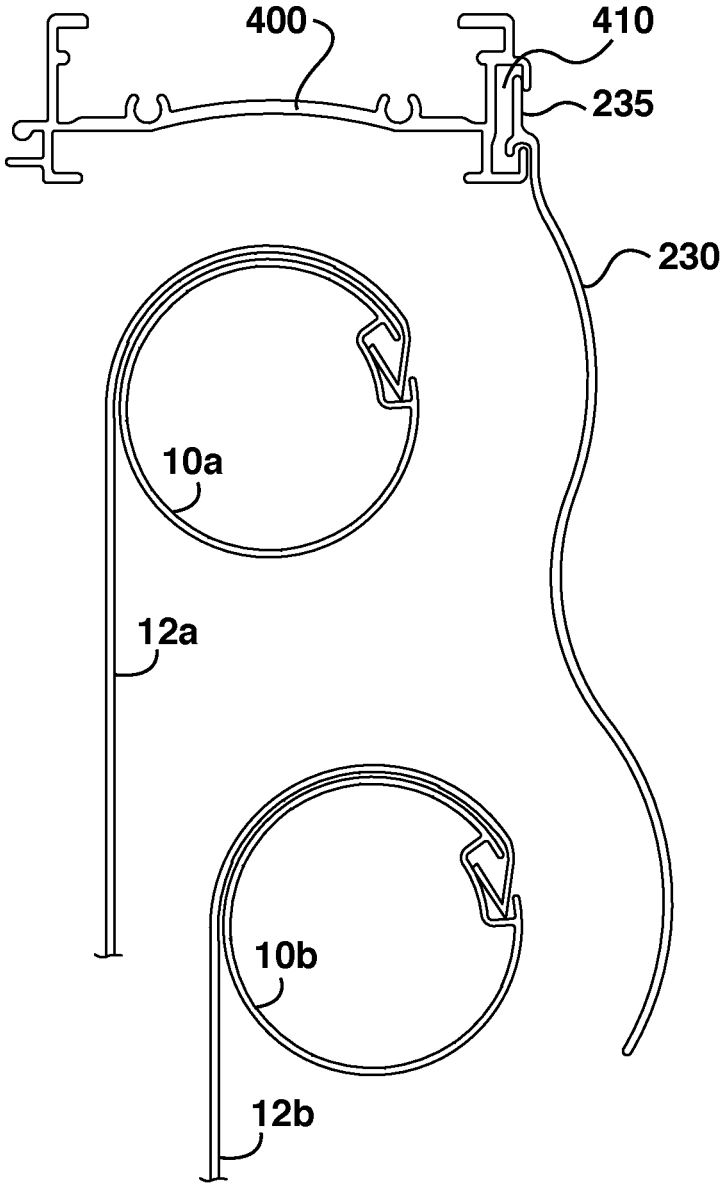
FIG. 7 is a cross-section view of the assembly of FIG. 1.

Additionally, or alternatively, assembly 1000 may be provided with one or more optional fascia plates. For example, as shown in FIGS. 1 and 2, fascia plate 230 provides a pleasing aesthetic appearance to the blind assembly 1000, e.g. by concealing the rollers and other parts discussed above. Fascia plate 230 may be secured to the brackets 100*a*, 100*b* and/or to headrail 400 in any suitable manner. Preferably, as shown in FIG. 7, fascia plate 230 has an upper engagement tongue 235 that can be releasably interlocked with a channel 410 provided on a front edge of headrail 400. Fascia plate 230 may be any suitable length, and may be cut to a desired length during the installation process.

Blind rollers 10*a*, 10*b* may be used to support a blind comprising any suitable blind material, including an opaque or 'black-out' blind (that blocks all or substantially all light), a translucent blind (that allows some light to pass through the blind material), and the like.

For example, as shown in FIGS. 1, 2, and 7, blind 12*a* may be a single layer translucent blind, and blind 12*b* may be a single layer black-out blind. Each blind 12*a*, 12*b* is supported from—and can be independently raised and/or lowered by—its respective blind roller 10*a*, 10*b*. As shown in FIGS. 1 and 2, bottom profiles 14*a*, 14*b* are preferably provided at the lower edge of each blind 12*a*, 12*b*, respectively (along with end caps 15*a* and 15*c* which are mounted to bottom profile 14*a*, and end caps 15*b* and 15*d* which are mounted to profile 14*b*) to provide additional mass to the bottom of the blind (e.g. for stability), and/or to provide a pleasing aesthetic appearance for the blind.

Figure 8A:
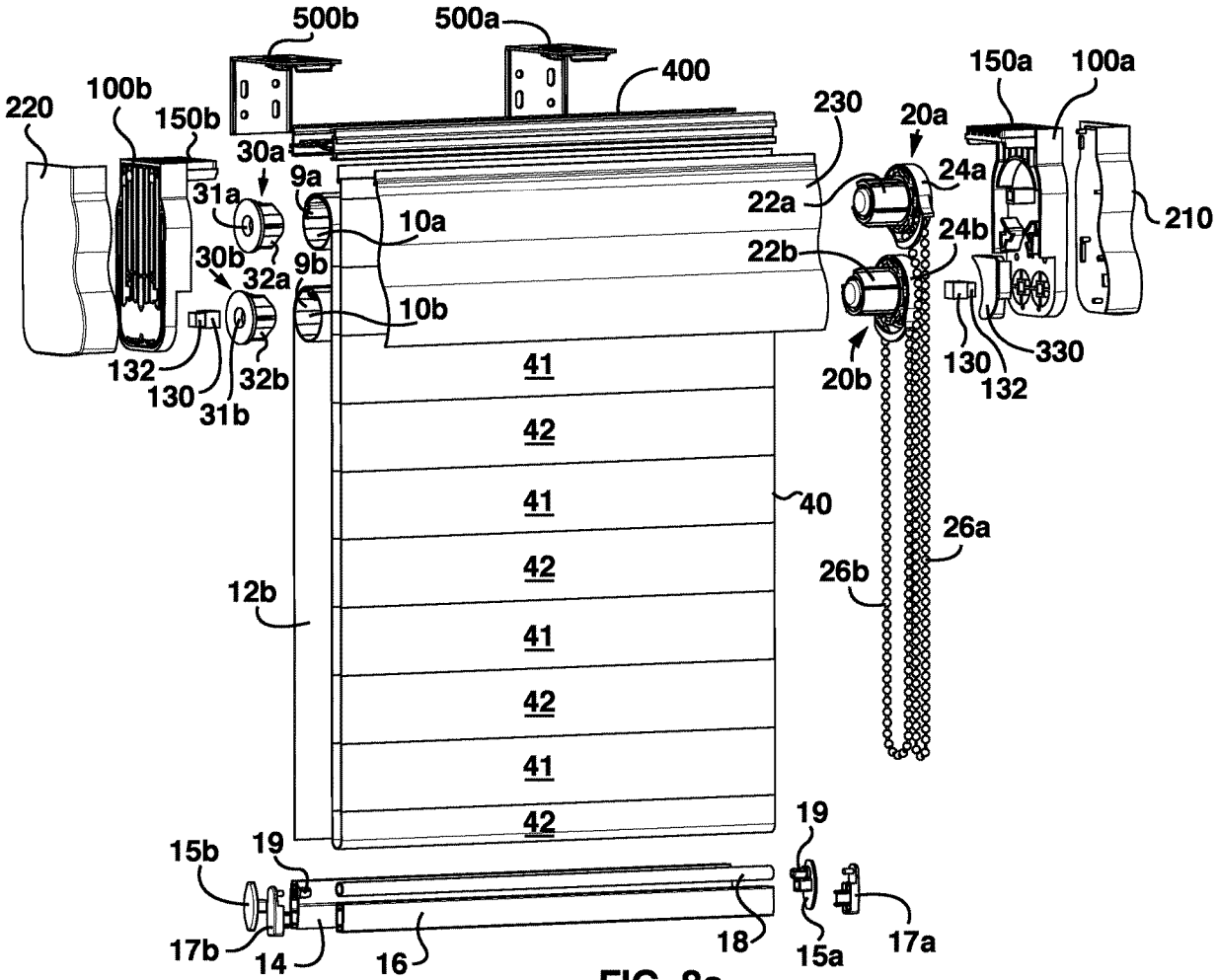
FIG. 8*a* is an exploded view of another configuration of a dual roller blind assembled using apparatus according to one embodiment.
Figure 8B:
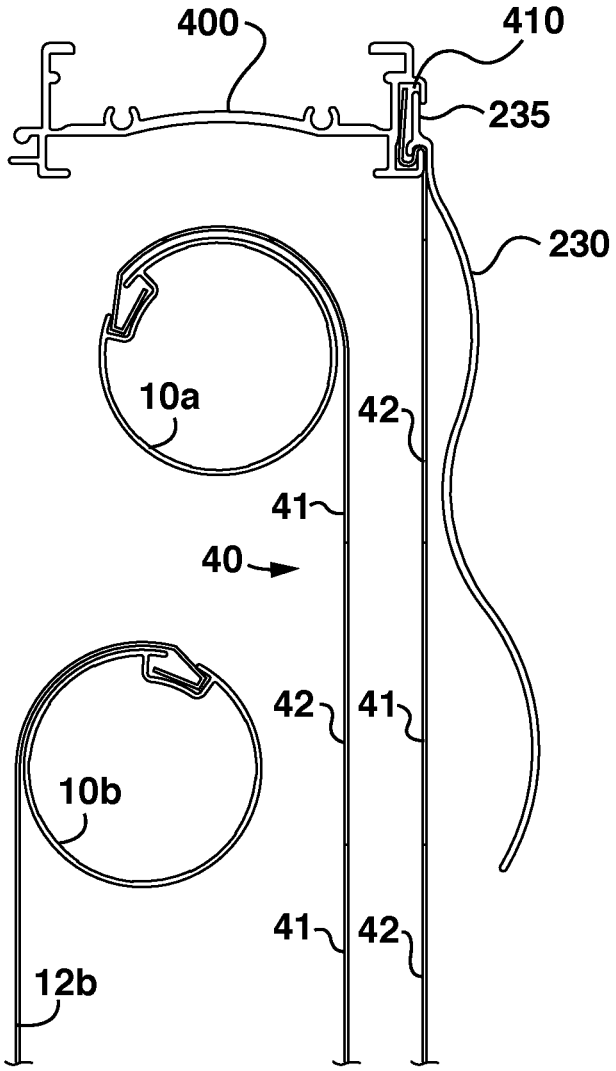
FIG. 8*b* is a cross-section view of the assembly of FIG. 8*a;*

As shown in FIGS. 8*a* and 8*b*, assembly 1000 may also be used to support a multi-layer blind 40. In the illustrated example, blind 40 is made of a material that has a series of horizontal strips of varying translucency; strips 41 are relatively translucent, while strips 42 are relatively opaque. As shown in FIG. 8*b*, one end of the blind 40 is secured to upper blind roller 10*a*, and the other end of the blind 40 is secured to the headrail 400. Preferably, the blind 40 is secured to the headrail by positioning an end of the blind in the channel 410 between the engagement tongue 235 of fascia plate 230, although those skilled in the art will appreciate that the blind 40 may be secured to the head rail 400 in any other suitable fashion. The blind 40 is also preferably looped through a bottom profile 16 having an internal roller 18 supported by bushings 19 and end caps 17*a*, 17*b*. In this arrangement, as the blind 40 is raised or lowered by rotating the blind roller 10*a*, the horizontal strips of material 41, 42 are brought into and out of alignment, altering the amount of light that can pass through the blind 40. It will be appreciated that blind 40 may alternatively be secured to lower blind roller 10*b* instead of to upper blind roller 10*a*, and that the other end of the blind 40 may be secured to an alternative fixed location on assembly 1000 instead of to headrail 400.

Figure 9A:
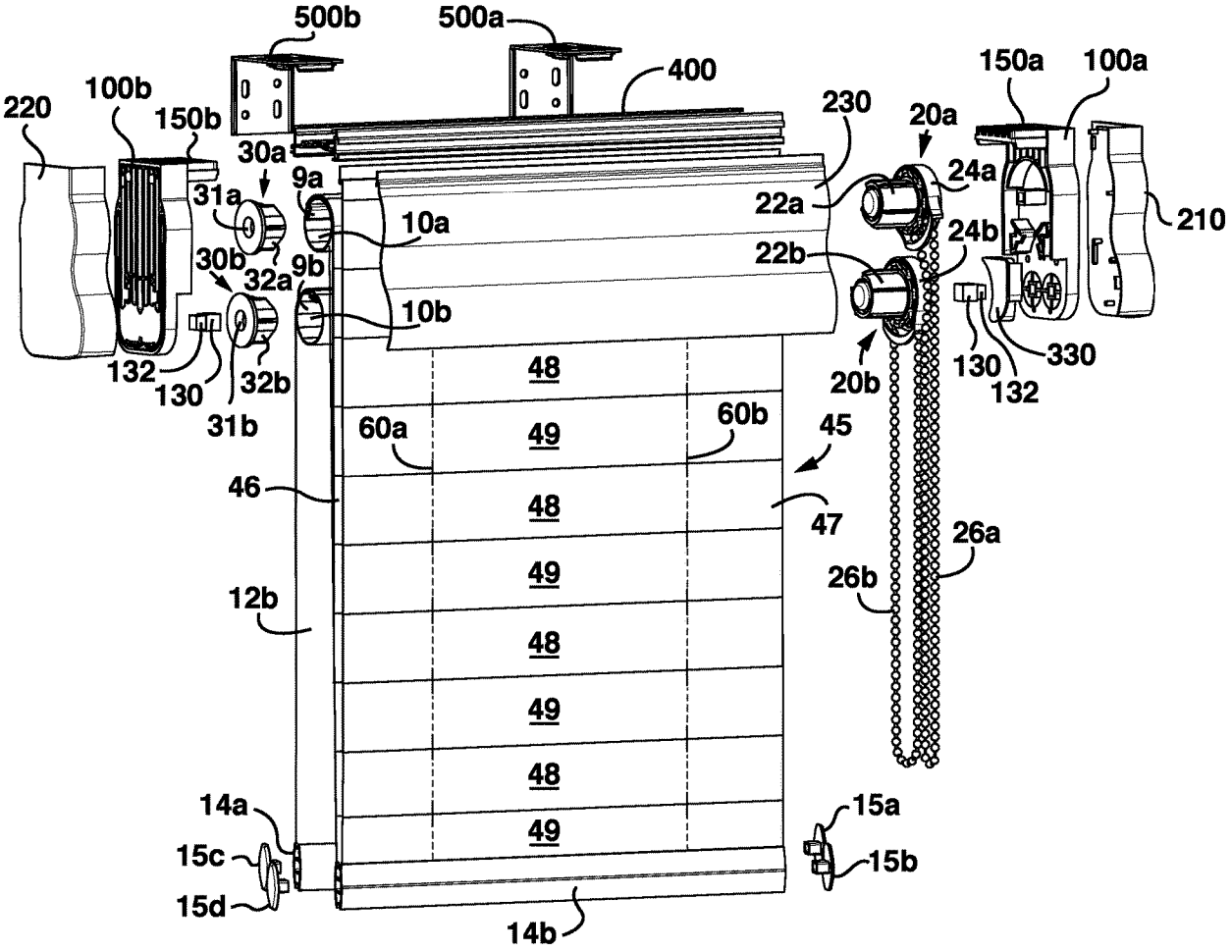
FIG. 9*a* is an exploded view of another configuration of a dual roller blind assembled using apparatus according to one embodiment.
Figure 9B:
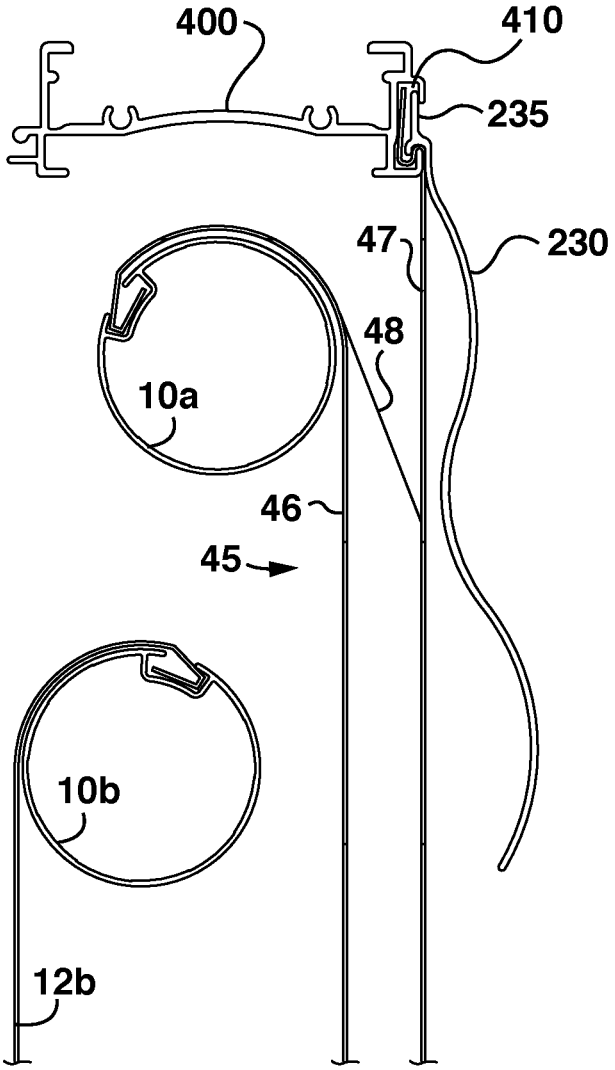
FIG. 9*b* is a cross-section view of the assembly of FIG. 9*a;*

As shown in FIGS. 9*a* and 9*b*, assembly 1000 may alternatively be used to support another type of multi-layer blind 45. In the illustrated example, blind 45 is made of a rear panel of material 46, and a front panel of material 47 that has a series of horizontal strips of varying translucency; strips 48 are relatively translucent, while strips 49 are relatively opaque. Blind 45 also has a number of threads or filaments 60*a*, 60*b* that are anchored at the bottom end of the front panel and woven through the front panel 47 at predetermined intervals. As shown in FIG. 9*b*, one end of the rear blind panel 46 is secured to upper blind roller 10*a*, and on end of the front blind panel 47 is secured to the headrail 400. Preferably, the blind panel 47 is secured to the headrail by positioning an end of the blind in the channel 410 between the engagement tongue 235 of fascia plate 230, although those skilled in the art will appreciate that the blind panel 47 may be secured to the head rail 400 in any other suitable fashion. The upper ends of filaments 60*a*, 60*b* are also secured to upper blind roller 10*a*. A bottom profile 14*b* is preferably provided to secure the lower edges of blind panels 46, 47 together and to provide additional mass to the bottom of the blind (e.g. for stability), and/or to provide a pleasing aesthetic appearance for the blind. In this arrangement, as the blind 45 is raised or lowered by rotating the blind roller 10*a*, the rear panel of material 46 rolls up like a typical roller blind, while the rolling up of filaments 60*a*, 60*b* results in the horizontal strips of material 48, 49 rolling up as in a roman shade. Accordingly, multi-layer blind 45 may be characterized as a hybrid zebra/roman blind. It will be appreciated that blind 45 may alternatively be secured to lower blind roller 10*b* instead of to upper blind roller 10*a*, and that the upper end of the blind panel 47 may be secured to an alternative fixed location on assembly 1000 instead of to headrail 400.

Figure 11:
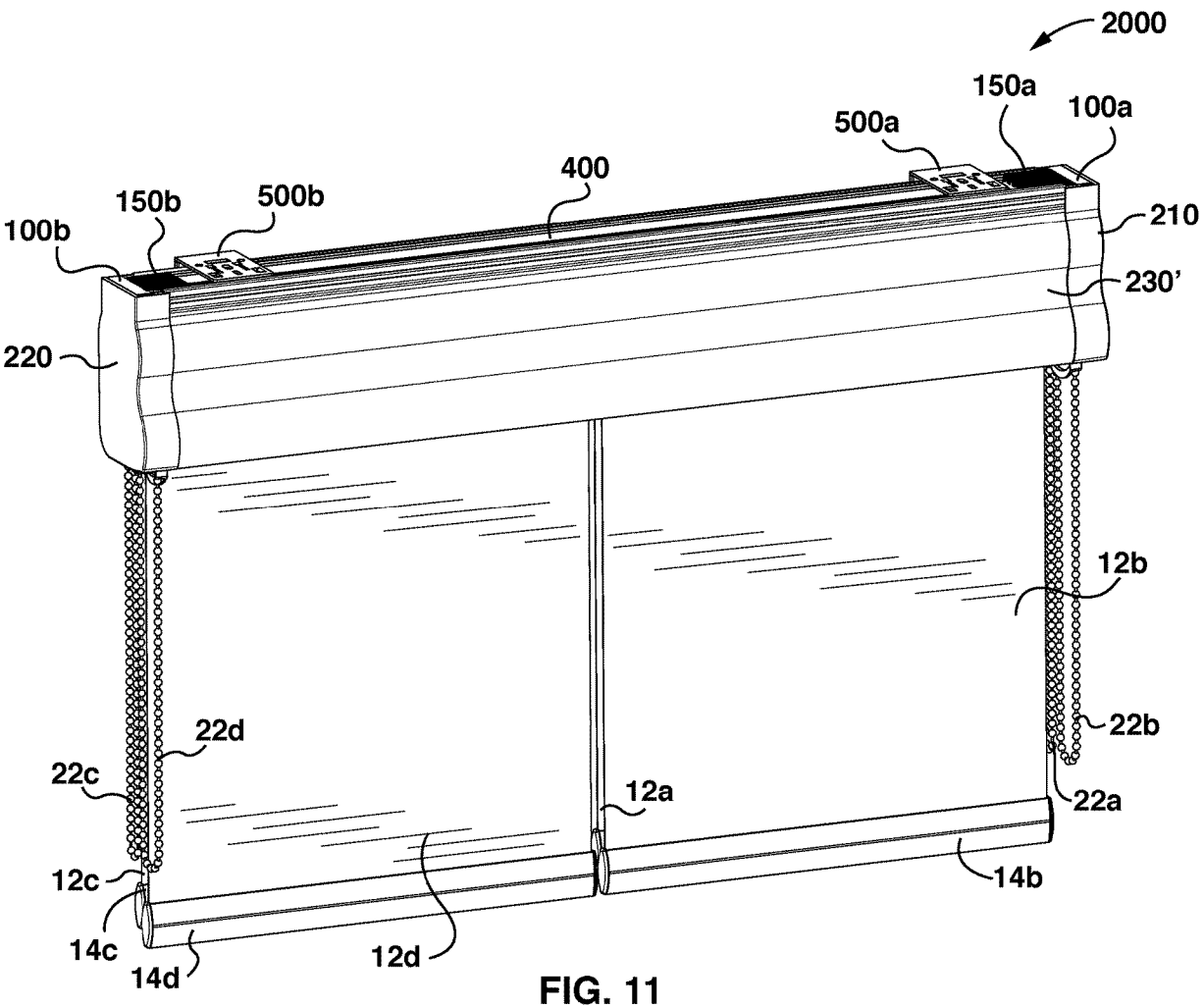
FIG. 11 is a perspective view of one configuration of a quad roller blind assembled using apparatus according to one embodiment.
Figure 12:
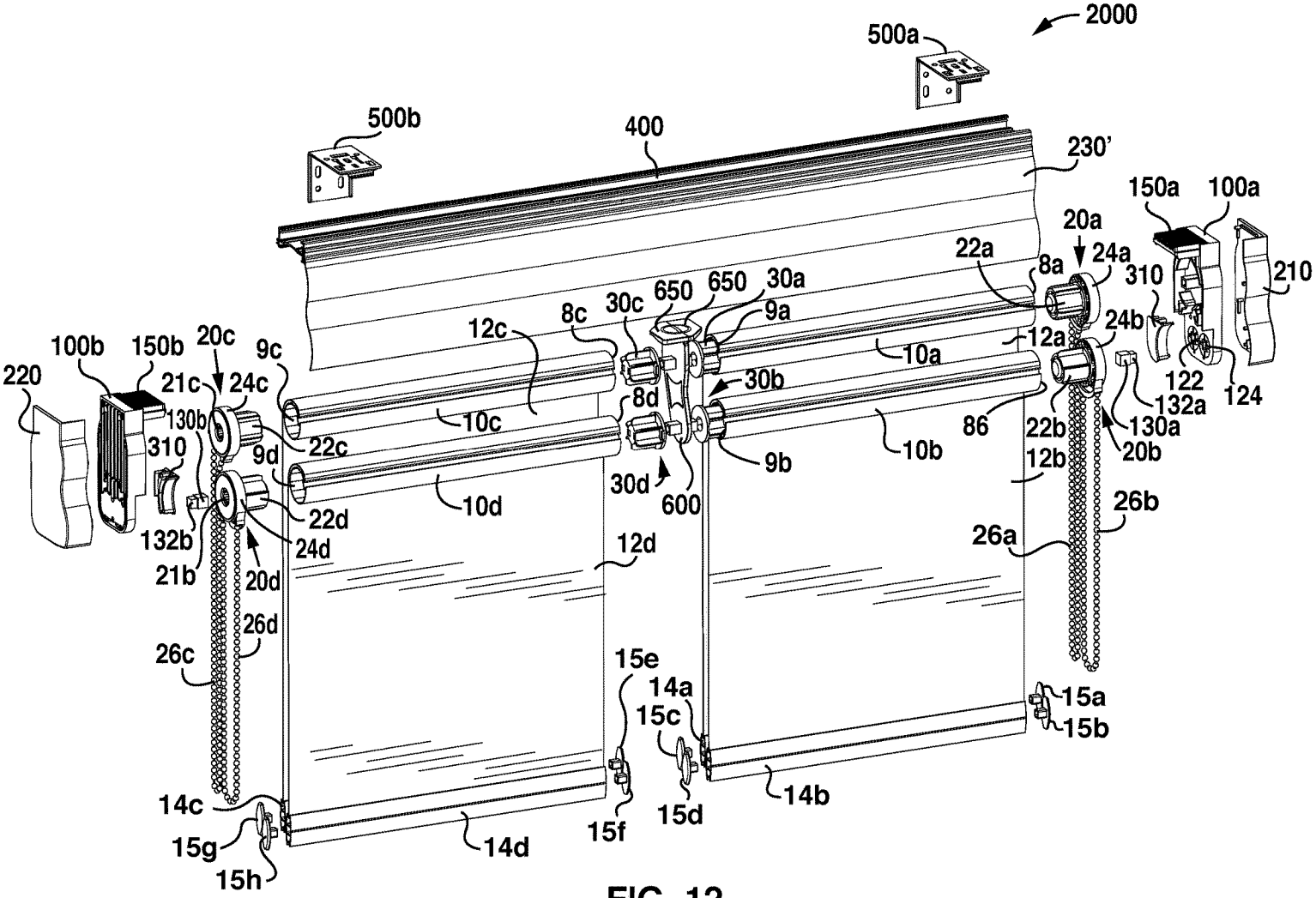
FIG. 12 is an exploded view of the assembly of FIG. 11.
Figure 13:
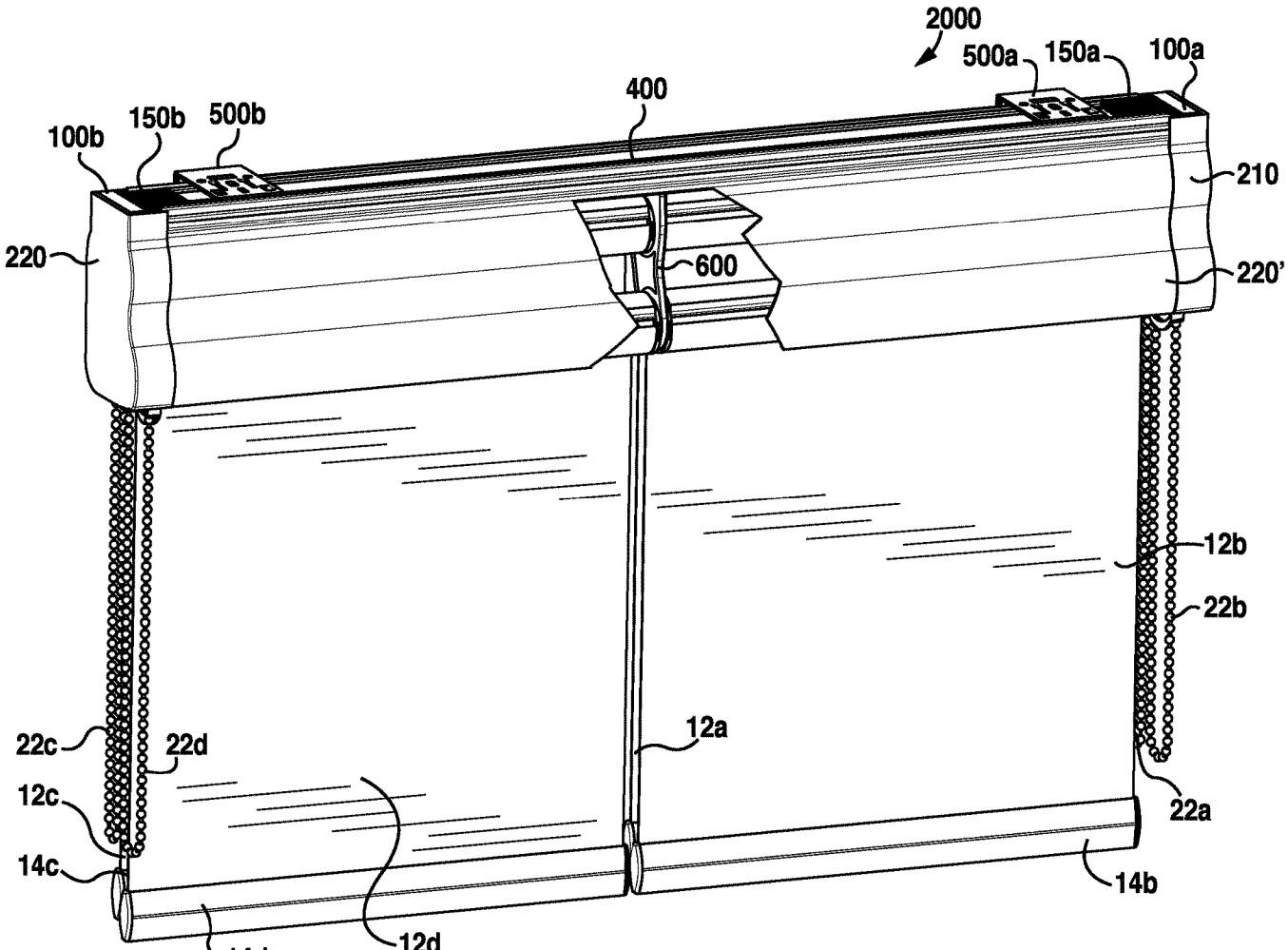
FIG. 13 is a cut-away perspective view of the assembly of FIG. 11 with a portion of the fascia plate removed for illustration purposes.

FIGS. 11 to 13 illustrate a quad roller blind assembly 2000 for supporting four roller blinds in front of an otherwise transparent or translucent portion of a building (e.g. a window, glass door, and the like). Assembly 2000 includes: a pair of end brackets 100*a*, 100*b* and an intermediate bracket 600 which, when assembled, support blind rollers 10*a*, 10*b*, 10*c*, and 10*d* via first blind control mechanisms 20*a*, 20*b*, 20*c*, 20*d*, and second blind control mechanisms 30*a*, 30*b*, 30*c*, and 30*d*; headrail 400, which supports the end brackets and the intermediate bracket (and thus the blind rollers); mounting brackets 500*a*, 500*b* for coupling the headrail to a wall and/or ceiling; and fascia plates 210, 220, and 230', which provide a pleasing aesthetic appearance to the blind assembly. Blinds 12*a*, 12*b*, 12*c*, and 12*d* hang from blind rollers 10*a*, 10*b*, 10*c*, and 10*d*, respectively. Components similar to those in assembly 1000 have been similarly numbered, and will not be described further.

Figure 14:
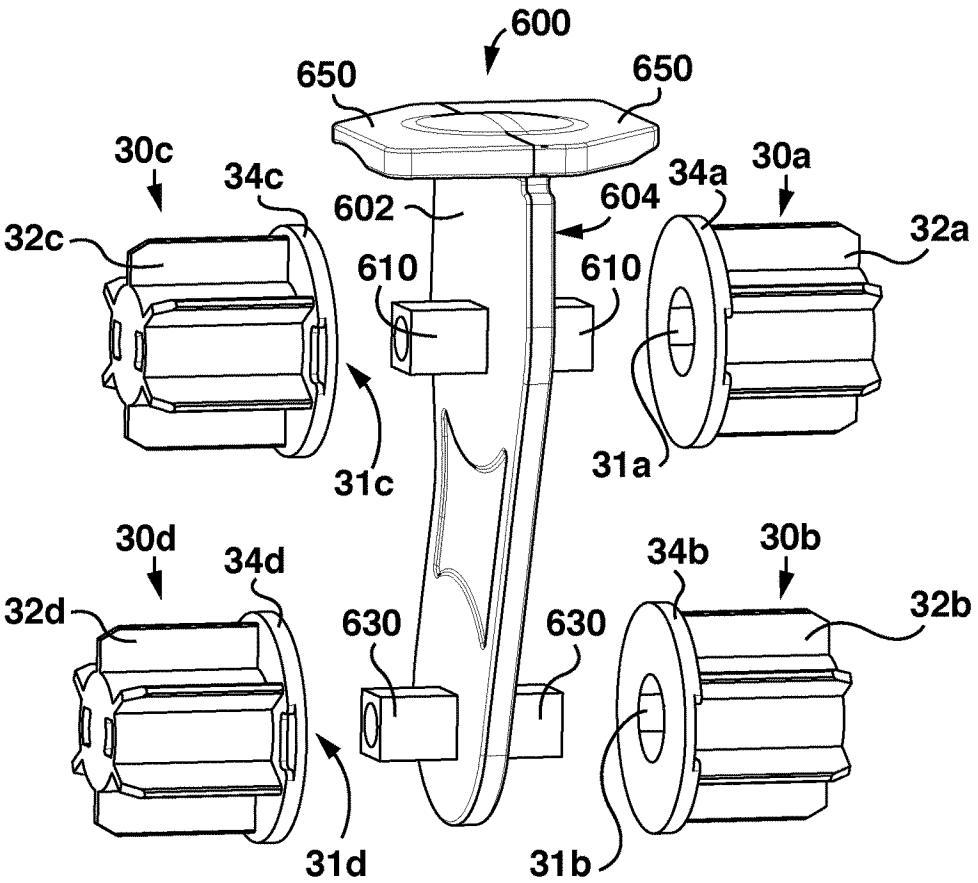
FIG. 14 is a perspective view of an intermediate bracket used in the assembly of FIG. 11, and blind control mechanisms for upper and lower blind rollers.

As shown in FIG. 14, intermediate bracket 600 has a first outer face 602 and a second opposed outer face 604. Each outer face 602, 604 has an upper engagement projection 610 extending therefrom. Upper engagement projection 610 is dimensioned to be received within a mounting recess 31 provided on a second blind control mechanism 30. Upper engagement projection 110 may also be dimensioned to be received within a mounting recess 21 provided on a first blind control mechanism 20.

Each outer face 602, 604 also has a lower engagement projection 630 extending therefrom. Lower engagement projection 630 is dimensioned to be received within a mounting recess 31 provided on a second blind control mechanism 30. Lower engagement projection 630 may also be dimensioned to be received within a mounting recess 21 provided on a first blind control mechanism 20.

Intermediate bracket 600 also has a top flange 650. Flange 650 may be used to couple the bracket 600 to an intermediate portion of headrail 400 using in any suitable fashion. For example, flange 650 may be dimensioned to provide a friction fit when inserted into the profile of headrail 400, e.g. by inserting the flange at the end of the profile and sliding it into the intermediate position, and/or by positioning bracket 600 at the intermediate position and rotating bracket 600 from an orientation in which flange 650 does not engage the profile of headrail 400 to an orientation in which that flange 650 engages the profile of headrail 400. Alternatively, or additionally, flange 650 may be otherwise configured to be mechanically coupled to headrail 400 (e.g. using a set screw or other mechanical fastener, etc.).

As shown, the upper engagement projections 610 are axially aligned with each other, and the lower engagement projections 630 are also are axially aligned with each other. However, the lower engagement projections 630 are horizontally offset from the upper engagement projections 610. Accordingly, intermediate bracket 600 may be secured to the headrail 400 in either a forward orientation (in which the lower engagement projections 630 are offset forwardly of the upper engagement projections 610, as shown in FIG. 12) or in a rearward orientation (in which the lower engagement projections 630 are offset rearwardly of the upper engagement projections 610).

Since intermediate bracket 600 may be secured to the headrail 400 in either a forward or rearward orientation, and since lower engagement connectors 130*a*, 130*b* may be secured to the end brackets 100*a*, 100*b* in either of that brackets lower engagement recesses 124, 122, an assembly 2000 may be configured to support four roller blinds in one of at least two different configurations using the same components.

For example, as shown in FIGS. 10-13, in one configuration the intermediate bracket 600 is secured to the headrail in a forward orientation, a lower engagement connector 130*a* is inserted into lower engagement recess 124*a* of bracket 100*a*, and a lower engagement connector 130*b* is inserted into lower engagement recess 122*b* of bracket 100*b*. First blind control mechanisms 20*a* and 20*b* are secured to bracket 100*a*, first blind control mechanisms 20*c* and 20*d* are secured to bracket 100*b*, and second blind control mechanisms 30*a*, 30*b*, 30*c*, and 30*d* are secured to intermediate bracket 600. In this configuration, the lower blind rollers 10*b*, 10*d* are secured in a forward position (i.e. away from a window being covered) relative to the upper blind rollers 10*a*, 10*c*.

In a second configuration (not shown), the intermediate bracket 600 is secured to the headrail in a rearward orientation, a lower engagement connector 130*a* is inserted into lower engagement recess 122*a* of bracket 100*a*, and a lower engagement connector 130*b* is inserted into lower engagement recess 124*b* of bracket 100*b* In this configuration, the lower blind rollers 10*b*, 10*d* are secured in a rearward position (i.e. closer to a window being covered) relative to the upper blind rollers 10*a*, 10*c*.

Assembly 1000 or 2000 may be secured to a structure to position blinds 12*a*, 12*b* in a desired position, e.g. relative to a window, glass door, and the like. Preferably, headrail 400 is secured to a wall and/or a ceiling, and the remainder of assembly 1000 or 2000 is supported directly or indirectly from headrail 400. Headrail 400 may be secured using any suitable method known in the art.

Figure 15:
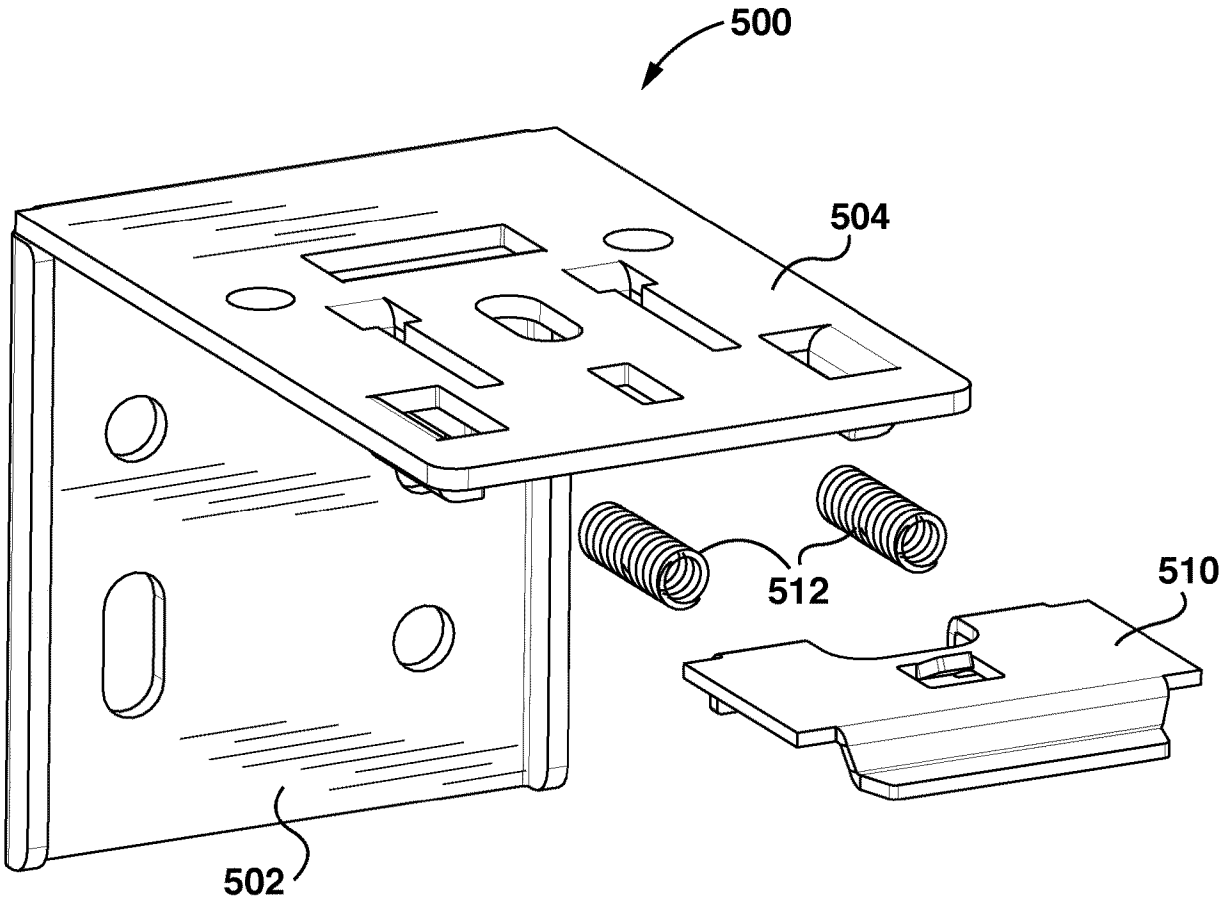
FIG. 15 is an exploded view of a mounting bracket that can be used to secure a headrail to a wall or ceiling.
Figure 16:
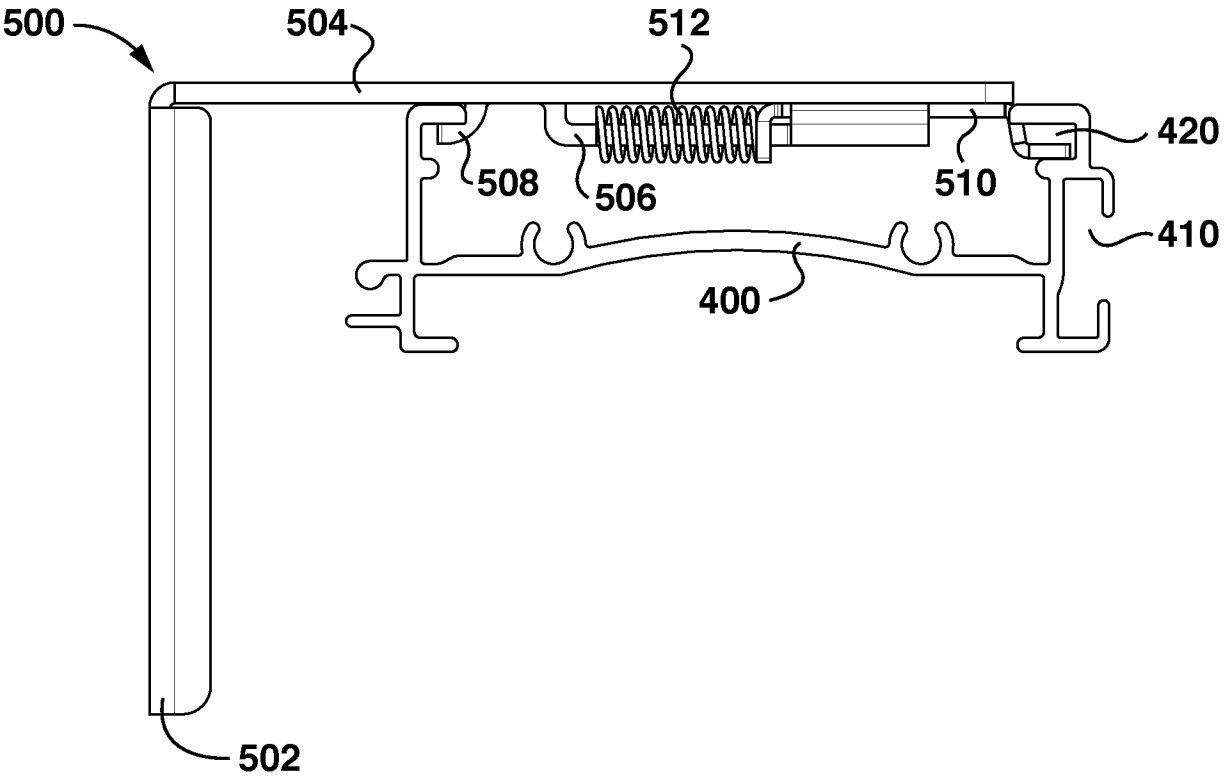
FIG. 16 is a cross-section view of the mounting bracket of FIG. 15 coupled to a headrail.

For example, as shown in FIGS. 15 and 16, one or more brackets 500 may be used to mount headrail 400 to a structure. Bracket 500 has a wall plate 502 having a one or more apertures configured to allow securement of plate 502 to a wall using one or more mechanical fasteners. Bracket 500 also has a top flange 504 and a headrail engagement plate 510 that is configured to slide along one or more elongate projections 506. One or more springs or other biasing members 512 are positioned between the top flange 504 and the headrail engagement plate 510 to bias the plate 510 away from wall plate 502. As shown in FIG. 16, when a profile at the rear of headrail 400 is engaged with an engagement feature 508 on an underside of headrail engagement plate 510, springs 512 bias the headrail engagement plate 510 towards a front edge of headrail 400, thereby securing engagement plate 510 with recess 420.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An apparatus for supporting an upper blind roller and a lower blind roller from a headrail in a selected one of at least eight configurations, the headrail having a front edge, each blind roller having a first end coupled to a first blind control mechanism, and a second end coupled to a second blind control mechanism, the apparatus comprising:

a bracket having an inner face, an outer face, and a top flange for coupling the bracket to an end of the headrail, the inner face having an upper engagement projection configured to releasably secure at least one of:

the first blind control mechanism for the upper blind roller in one of at least two mechanism orientations, and the second blind control mechanism for the upper blind roller, the inner face also having at least two lower engagement recesses, each lower engagement recess configured to selectively releasably receive a lower engagement connector, the lower engagement connector configured to releasably secure at least one of:

the first blind control mechanism for the lower blind roller, and the second blind control mechanism for the lower blind roller;

wherein, in a first configuration of the at least eight configurations:

the first blind control mechanism for the upper blind roller is secured to the bracket by the upper engagement projection in a first mechanism orientation, the lower engagement connector is secured in a first of the at least two lower engagement recesses, and the first blind control mechanism for the lower blind roller is secured to the bracket by the lower engagement connector;

wherein, in a second configuration of the at least eight configurations:

the first blind control mechanism for the upper blind roller is secured to the bracket by the upper engagement projection in the first mechanism orientation, the lower engagement connector is secured in the first lower engagement recess, and the second blind control mechanism for the lower blind roller is secured to the bracket by the lower engagement connector;

wherein, in a third configuration of the at least eight configurations:

the second blind control mechanism for the upper blind roller is secured to the bracket by the upper engagement projection, the lower engagement connector is secured in the first lower engagement recess, and the first blind control mechanism for the lower blind roller is secured to the bracket by the lower engagement connector;

wherein, in a fourth configuration of the at least eight configurations:

the second blind control mechanism for the upper blind roller is secured to the bracket by the upper engagement projection, the lower engagement connector is secured in the first lower engagement recess, and the second blind control mechanism for the lower blind roller is secured to the bracket by the lower engagement connector;

wherein, in a fifth configuration of the at least eight configurations:

the first blind control mechanism for the upper blind roller is secured to the bracket by the upper engagement projection in a second mechanism orientation, the lower engagement connector is secured in a second of the at least two lower engagement recesses, and the first blind control mechanism for the lower blind roller is secured to the bracket by the lower engagement connector;

wherein, in a sixth configuration of the at least eight configurations:

the first blind control mechanism for the upper blind roller is secured to the bracket by the upper engagement projection in the second mechanism orientation, the lower engagement connector is secured in the second lower engagement recess, and the second blind control mechanism for the lower blind roller is secured to the bracket by the lower engagement connector;

wherein, in a seventh configuration of the at least eight configurations:

the second blind control mechanism for the upper blind roller is secured to the bracket by the upper engagement projection, the lower engagement connector is secured in the second lower engagement recess, and the first blind control mechanism for the lower blind roller is secured to the bracket by the lower engagement connector;

and wherein, in an eighth configuration of the at least eight configurations:

the second blind control mechanism for the upper blind roller is secured to the bracket by the upper engagement projection, the lower engagement connector is secured in the second lower engagement recess, and the second blind control mechanism for the lower blind roller is secured to the bracket by the lower engagement connector.

2. The apparatus of claim 1, wherein the first lower engagement recess is positioned forward of the upper engagement projection, and the second lower engagement recess is positioned rearward of the upper engagement projection.

3. The apparatus of claim 1, wherein the first blind control mechanism for the upper blind roller comprises an electric motor.

4. The apparatus of claim 1, wherein the first blind control mechanism for the upper blind roller comprises a control cord, and wherein, in the first mechanism orientation, the control cord is angled forwardly, and wherein, in the second mechanism orientation, the control cord is angled rearwardly.

5. The apparatus of claim 4, wherein the inner face further comprises a front control cord separating projection positioned below and forward of the upper engagement projection, and a rear control cord separating projection positioned below and rearward of the upper engagement projection.

6. The apparatus of claim 1, wherein the bracket is a first bracket, and the apparatus further comprises a second bracket having an inner face, an outer face, and a top flange for coupling the second bracket to another end of the headrail;

the inner face of the second bracket having a second upper engagement projection configured to releasably secure at least one of:

the first blind control mechanism for the upper blind roller in one of at least two mechanism orientations, and the second blind control mechanism for the upper blind roller;

the inner face of the second bracket also having at least two second lower engagement recesses, each second lower engagement recess configured to selectively releasably receive a second lower engagement connector, the second lower engagement connector configured to releasably secure at least one of:

the first blind control mechanism for the lower blind roller, and the second blind control mechanism for the lower blind roller.

7. The apparatus of claim 6, wherein the first and second brackets are configured such that, in each of the first, second, third, fourth, fifth, sixth, seventh, and eighth configurations, the first and second brackets are interchangeable with each other.

8. The apparatus of claim 1, wherein the first blind control mechanism for the upper blind roller comprises a clutch mechanism, and the second blind control mechanism for the upper blind roller comprises an end plug.

9. The apparatus of claim 8, wherein the first blind control mechanism for the lower blind roller comprises a clutch mechanism, and the second blind control mechanism for the lower blind roller comprises an end plug.

10. The apparatus of claim 9, wherein the first blind control mechanisms for the upper and lower blind rollers are configured such that, in each of the first, second, third, fourth, fifth, sixth, seventh, and eighth configurations, the first blind control mechanisms are interchangeable with each other.

11. An apparatus for supporting first and second upper blind rollers and first and second lower blind rollers from a headrail in a selected one of at least two configurations, the headrail having a front edge, each blind roller having a first end coupled to a first blind control mechanism, and a second end coupled to a second blind control mechanism, the apparatus comprising:

a pair of end brackets, each end bracket having an inner face, an outer face, and a top flange for coupling each end bracket to an opposing end of the headrail, the inner face of each end bracket having an upper engagement projection configured to releasably secure the first blind control mechanism of one of the upper blind rollers in one of at least two mechanism orientations;

the inner face of each end bracket also having first and second lower engagement recesses, each lower engagement recess configured to selectively releasably receive a lower engagement connector, each lower engagement connector configured to releasably secure the second blind control mechanism of one of the lower blind rollers; and an intermediate bracket having a pair of opposed outer faces, and a top flange for coupling the intermediate bracket to a portion of the headrail located between the opposing ends of the headrail in one of a forward orientation and a rearward orientation, the outer faces of the intermediate bracket each having an intermediate upper engagement projection for releasably securing the second blind control mechanism of one of the upper blind rollers, and an intermediate lower engagement projection for releasably securing the second blind control mechanism of one of the lower blind rollers, wherein in the forward orientation, the intermediate lower engagement projections are positioned forward of the intermediate upper engagement projections, and in the rearward orientation, the intermediate lower engagement projections are positioned rearward of the intermediate upper engagement projections;

wherein, in a first configuration of the at least two configurations:

the intermediate bracket is in the forward orientation, and lower engagement connectors are secured in one of the first and second lower engagement recesses of each end bracket, such that the lower engagement connectors and the intermediate lower engagement projections define a forward lower blind axis, the first blind control mechanisms for the upper blind rollers are each secured to one of the end brackets by the upper engagement projection of an adjacent end bracket in a rearward mechanism orientation, the second blind control mechanisms for the upper blind rollers are each secured to one of the intermediate upper engagement projections, the first blind control mechanisms for the lower blind rollers are each secured to one of the end brackets by the lower engagement connector secured in the adjacent end bracket, and the second blind control mechanisms for the lower blind rollers are each secured to one of the intermediate lower engagement projections;

and wherein, in a second configuration of the at least two configurations:

the intermediate bracket is in the rearward orientation, and the lower engagement connectors are secured in one of the first and second lower engagement recesses of each end bracket, such that the lower engagement connectors and the intermediate lower engagement projections define a rearward lower blind axis, the first blind control mechanisms for the upper blind rollers are each secured to one of the end brackets by the upper engagement projection of that end bracket in a forward mechanism orientation, the second blind control mechanisms for the upper blind rollers are each secured to one of the intermediate upper engagement projections, the first blind control mechanisms for the lower blind rollers are each secured to one of the end brackets by the lower engagement connector securable in the adjacent end bracket, and the second blind control mechanisms for the lower blind rollers are each secured to one of the intermediate lower engagement projections.

12. The apparatus of claim 11, wherein, for each end bracket: (i) the first lower engagement recess is offset to one side of the upper engagement projection, and (ii) the second lower engagement recess is offset to another side of the upper engagement projection.

13. The apparatus of claim 11, wherein at least one of the first blind control mechanisms comprises an electric motor.

14. The apparatus of claim 11, wherein the first blind control mechanisms for the upper blind rollers each comprise a control cord.

15. The apparatus of claim 14, wherein the inner face of each end bracket further comprises a first control cord separating projection positioned below and offset to one side of the upper engagement projection of that end bracket, and a second control cord separating projection positioned below and offset to another side of the upper engagement projection of that end bracket.

* * * * *